United States Patent [19]

Cline

[11] Patent Number: 4,903,298

[45] Date of Patent: Feb. 20, 1990

[54] SYSTEM FOR PROVIDING ENCRYPTION AND DECRYPTION OF VOICE AND DATA TRANSMISSIONS TO AND FROM AN AIRCRAFT

[75] Inventor: James D. Cline, Mission Viejo, Calif.

[73] Assignee: Sunstrand Data Control, Inc., Redmond, Wash.

[21] Appl. No.: 225,065

[22] Filed: Jul. 27, 1988

[51] Int. Cl.[4] ..... H04K 1/00

[52] U.S. Cl. ..... 380/9; 379/62; 455/89; 455/98

[58] Field of Search ..... 380/6, 9, 52, 53, 59, 380/49, 50; 364/424.05; 379/58, 62; 455/54, 66, 89, 98

[56] References Cited

U.S. PATENT DOCUMENTS

| | | | |
|---|---|---|---|
| 2,463,502 | 3/1949 | Atkins | 380/6 |
| 3,541,258 | 11/1970 | Doyle et al. | 380/6 X |
| 4,325,141 | 4/1982 | Ghose | 455/98 X |
| 4,584,707 | 4/1986 | Goldberg et al. | 455/54 X |
| 4,747,158 | 5/1988 | Goldberg et al. | 455/54 X |
| 4,763,351 | 8/1988 | Lipscher et al. | 380/23 X |

OTHER PUBLICATIONS

"Intercompany Confidential" slide presentation produced by the Applicant, Summer 1986.

SSC-200 Communication Security System brochure, The Cline Corporation, Sep. 1987.

CYCOMM-1000 Series Voice Scrambler brochure, CYCOMM, Inc.

*Primary Examiner*—Stephen C. Buczinski

*Assistant Examiner*—Bernarr Earl Gregory

*Attorney, Agent, or Firm*—Knobbe, Martens, Olson & Bear

[57] ABSTRACT

A data communication system for an aircraft includes a voice encryption unit that is selectably included in the audio path between a user and a radio. The data communication system is interconnected so that the unencrypted audio path of a user is isolated from other users, thus providing the user with a secure, private communications link within the aircraft, as well as between the aircraft and a ground station. The system includes an audio path from the cockpit to the encryption unit and an audio path from the passenger cabin to the encryption unit, and further includes a control unit in each of the cockpit and the cabin so that control of the encryption unit can be selectably switched between the cockpit and the passenger cabin.

13 Claims, 16 Drawing Sheets

CABIN TELEPHONE HANDSET
152
5e

COCKPIT TELEPHONE HANDSET
150
5c 100
124
5d
120
122
5b
160
EDU
132
HF
VHF
134
130

250
CABIN CONTROL UNIT
ALL 1 2 3 4 CLR
300
298
296
294
292
290

240
COCKPIT CONTROL UNIT
COCKPIT
CABIN
260
270
280
278
276
274
272
262
HF
VHF
PHONE

SYSTEM FOR PROVIDING ENCRYPTION AND DECRYPTION OF VOICE AND DATA TRANSMISSIONS TO AND FROM AN AIRCRAFT

FIELD OF THE INVENTION

The present invention is related to voice and data radio communication between an aircraft and a ground station, and more particularly, to communications utilizing a scrambler or encoder for protection the communications from interception by other persons.

BACKGROUND OF THE INVENTION

Nonmilitary aircraft utilize several radio links with the ground for business communications by crew or passengers. Pilots of business aircraft need to utilize these channels on a frequent basis for coordination of meetings, transportation, and other logistical functions because of their non-routine schedules. Even more often, the fast pace of their passengers, generally senior business and government executives, demands reliable and secure voice communication to maintain touch with their diverse organizations and activities.

Different radio types and frequencies are utilized for these functions since no single type provides communication in all geographical areas. Furthermore, strict governmental allocation determines the applications for which frequencies may be used. Thus, for example, although most civilian air traffic control is conducted over VHF (Very High Frequency) radios, additional frequencies in these same bands are used as "company" channels for exchange of operational messages such as those regarding schedules or ground transportation requirements. For this type of radio using one frequency for both parties, each must push a button on their microphone when speaking to turn on the transmitter (Push-to-talk or PTT). Following each transmission, they must then release the PTT to relinquish the frequency for the other party to respond. This process is known as simplex operation.

For longer range operation necessitated by remote area or over-water flights, a second set of radios using the HF (High Frequency) band must be switched into the crew's audio systems of microphones and headphones. Here again, the operation is simplex and separate frequencies are assigned for differing requirements. Frequently, marititime channels are used to call commercial ground stations which then tie the aircraft transmissions into international public switched telephone networks. Thus long range links may be established between the remote business traveller and almost any telephone in the world.

Next, a unique air-to-ground radiotelephone network is available within the Continental United States, Southern Canada, and Northern Mexico. This includes almost one hundred ground stations using UHF (Ultra High Frequency). Unlike the more common simplex VHF and HF radios, this system allows both parties to speak simultaneously—full duplex operation. The party on the ground transmits continuously on one frequency while the party in the aircraft transmits continuously on a second frequency. UHF is the communication link most used by the passenger today. In the near future, however, new links including satellite relay will be established for telephonic communication to the aircraft. It is desirable that any system addressing the multiple communication links existing today be readily adaptable to such new, full duplex links as they become available.

Thus, wide ranging business aircraft require a diverse suite of communication radios with differing technical characteristics and interface requirements. Although these several different communication links must be frequently utilized by most business jet aircraft, none permit private conversations. That is, all conversations, no matter how sensitive their nature, may be monitored by any party purchasing commonly available commercial receivers, a reality that exposes the users to potential hazard. For example, schedule coordination for significant public figure passengers often require broadcasts of movements which may be easily intercepted by terrorist organizations or others with even a minimum of technical sophistication. Moreover, the press of decisions frequently requires radiotelephone discussions by passengers of sensitive information which can be extremely detrimental to the speakers' organizations if received by interested outside parties.

Numerous technologies and devices exist which permit disguising or encrypting voice and data communications over any one of these channels. Typically, a device to scramble, distort, or in some other fashion rearrange audio frequency energy into an unrecognizable presentation, is installed between the microphone and transmitter input of each channel. Similarly, audio coming from the receiver paired with that transmitter is routed through a decryption unit before being carried to the airborne listener.

Since multiple channels are utilized in these aircraft operations, one solution to providing the necessary protection would be to install multiple and different encryption systems on board the aircraft which are appropriate to the individual link characteristics, voltage levels, and impedances. However, as aircraft are of necessity extremely sensitive to additional weight or power consumption, this is not a solution for any but the largest commercial aircraft. The cost of such duplicated equipment and its installation is significant, particularly since redundant radios might be required to provide a separate channel for passengers in order to avoid sharing all discussions with the flight crew. In business aircraft, the executive passengers are frequently the primary users for private radio-telephone channels, yet the crew is responsible for all radio transmissions and should maintain ultimate control over such security functions. In a typical business aircraft, the audio input and output of the radio are typically routed in common to both the cockpit and cabin telephone handsets. Thus, although the passenger's communications may be protected from interception by persons outside the aircraft, the aircraft crew will be able to eavesdrop. Therefore, means are needed to prevent the crew from eavesdropping on the communications.

In summary, there is a broad and present need for equipment (1) to apply high security encryption processes to all the diverse communications channels of business aircraft in the smallest possible size and weight configuration; (2) to provide passenger control over radiotelephone encryption when appropriate while maintaining the flight crew's ultimate control over such usage; and (3) to provide separate and private audio channels for crew and passengers as necessary while permitting shared communication channels when desired.

SUMMARY OF THE INVENTION

An apparatus is disclosed which comprises an integrated communication security system with two or more audio ports for protecting voice or data communications over diverse radio types within an aircraft. A microprocessor, controlled by two or more remotely located control/display units, directs switching circuitry to intercept user audio and route it through commercially available encryption/decryption modules.

One audio port is preferably a shared radiotelephone audio port, which is further separated into cabin and cockpit paths which are combined to provide common audio during clear operation and isolated to the user in command during encrypted operation. Although the available radiotelephone today is UHF air-to-ground, future full duplex links such as satellite relay in other frequency bands are amenable to this approach as well. The audio from the other conventional simplex VHF and HF radios, normally limited to and controlled from the cockpit (and infrequently used by the passengers), is not further separated.

DETAILED DESCRIPTION OF THE PREFERRED EMBODIMENT

Figure 1:
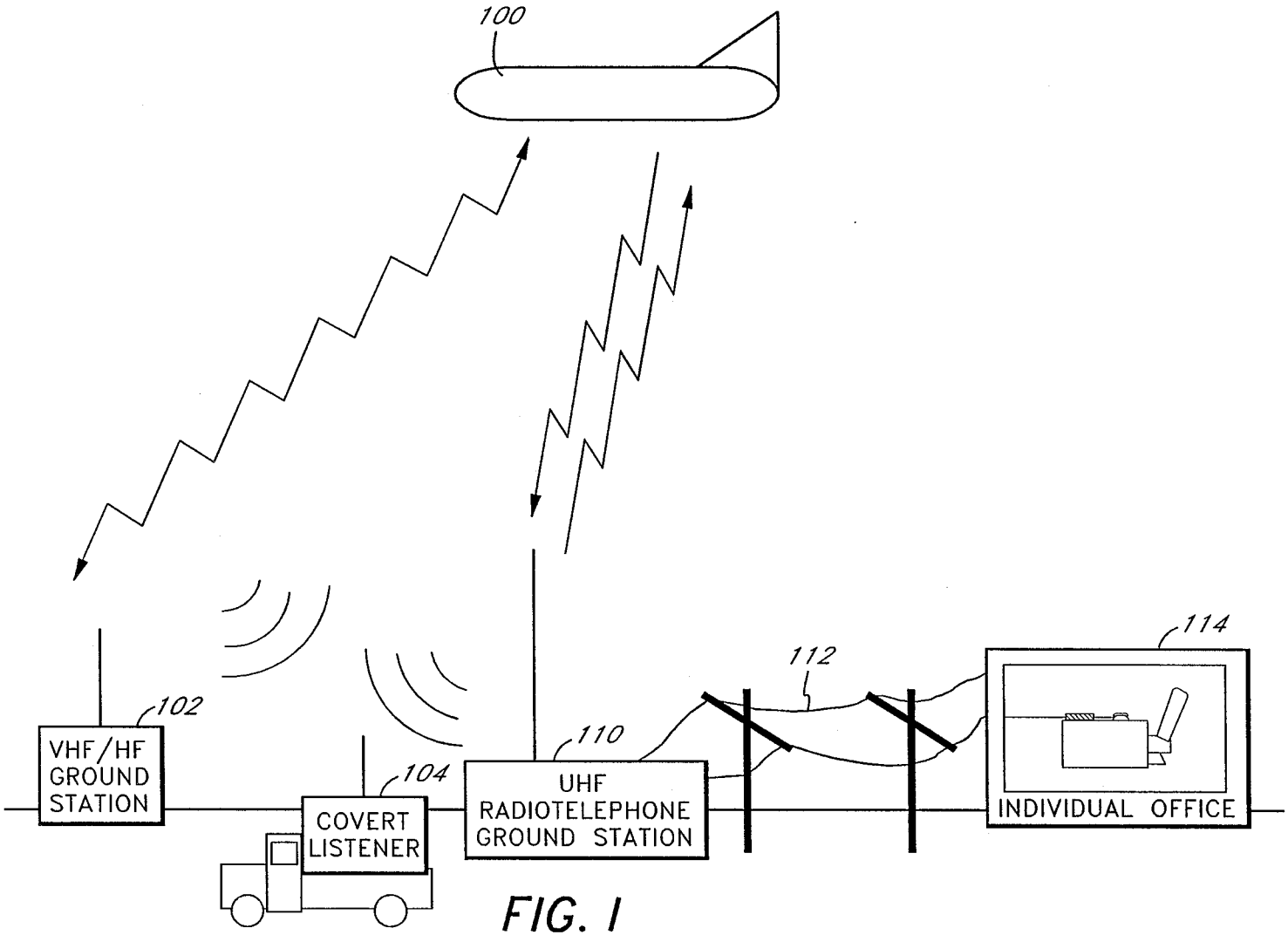
FIG. 1 shows representative links from the aircraft to the ground, both radio to radio, and radio to telephone.

FIG. 1 pictorially illustrates an exemplary aircraft 100 in flight. Also illustrated are exemplary communication links between the aircraft and the ground. For example when a ground station 102 is the intended contact for the aircraft 100, communication between the ground station 102 and the aircraft may be provided by a particular radio type such as amplitude modulated VHF or single side band HF. Such communications may be for example between the aircraft 100 and an FAA control center or tower, or between the aircraft 100 and a private facility authorized to transmit in the selected frequency range. The communication between the aircraft 100 and the ground station 102 can readily be intercepted by a covert listener 104 using conventional commercial equipment.

In similar manner, a second ground station 110 operating, for example, with a full duplex, dual frequency UHF FM transceiver type, can receive a call from the aircraft and patch it into a public switched telephone network 112 whereby it is transmitted to the ultimate contact in a office 114. Again, the conversation can be readily intercepted by the covert listener 104.

Figure 2:
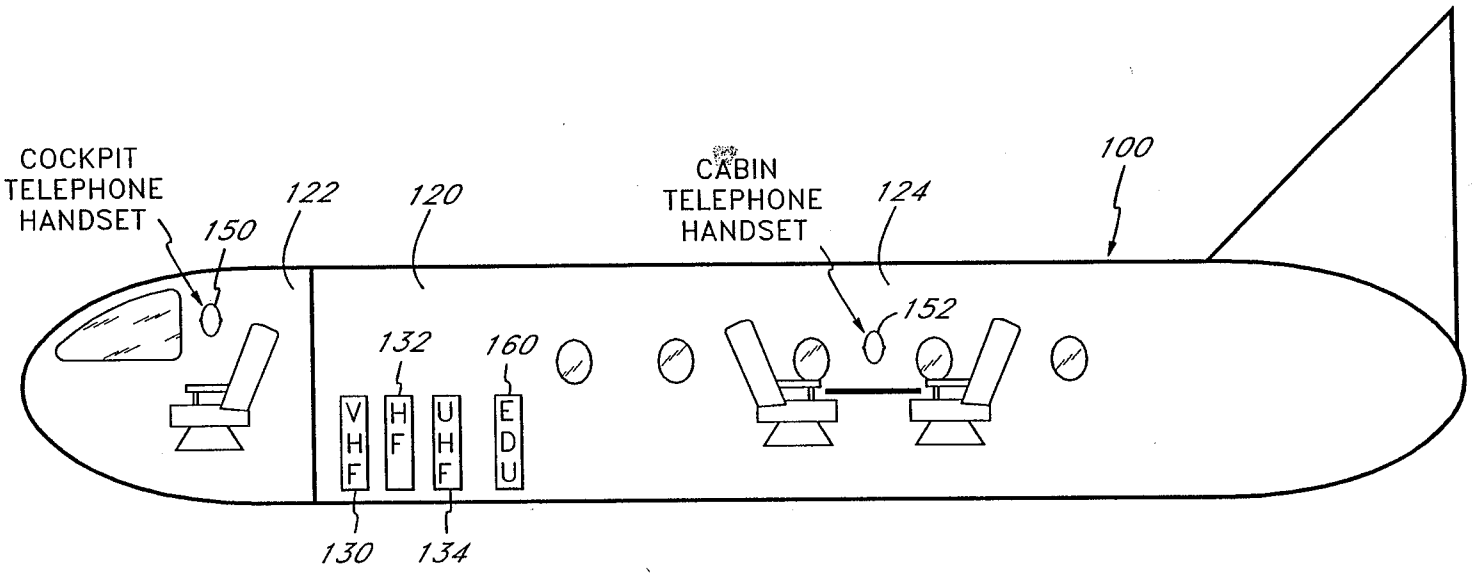
FIG. 2 illustrates the interior of a typical business aircraft with schematic representations of the communication equipment that can be used by the cockpit crew and by passengers.

FIG. 2 pictorially illustrates an exemplary aircraft interior 120 having a forward cockpit 122 and a rear cabin 124. Also illustrated in simple schematic form are a plurality of radio transceivers, namely a VHF transceiver 130 (e.g., a Rockwell Collins Model VHF 20), a HF transceiver 132 (e.g., a Rockwell Collins Model HF220), and a UHF transceiver 134 (e.g., a Wulfsberg Flitefone TM Model VI). In a typical aircraft installation, illustrated in schematic form in FIG. 3, a pilot in the cockpit 122 has access to VHF transceiver 130 and the HF transceiver 132 via an aircraft audio control system 136 which selectively routes the audio input and output from one of the transceivers 130 and 132 to a microphone 140 and a headphone 142. One familiar with aircraft communication systems will understand that the VHF transceiver 130 and the HF transceiver 132 are only representative of numerous communication and navigation radio systems that may be installed on a typical aircraft and selectively used by the pilot.

Figure 3:
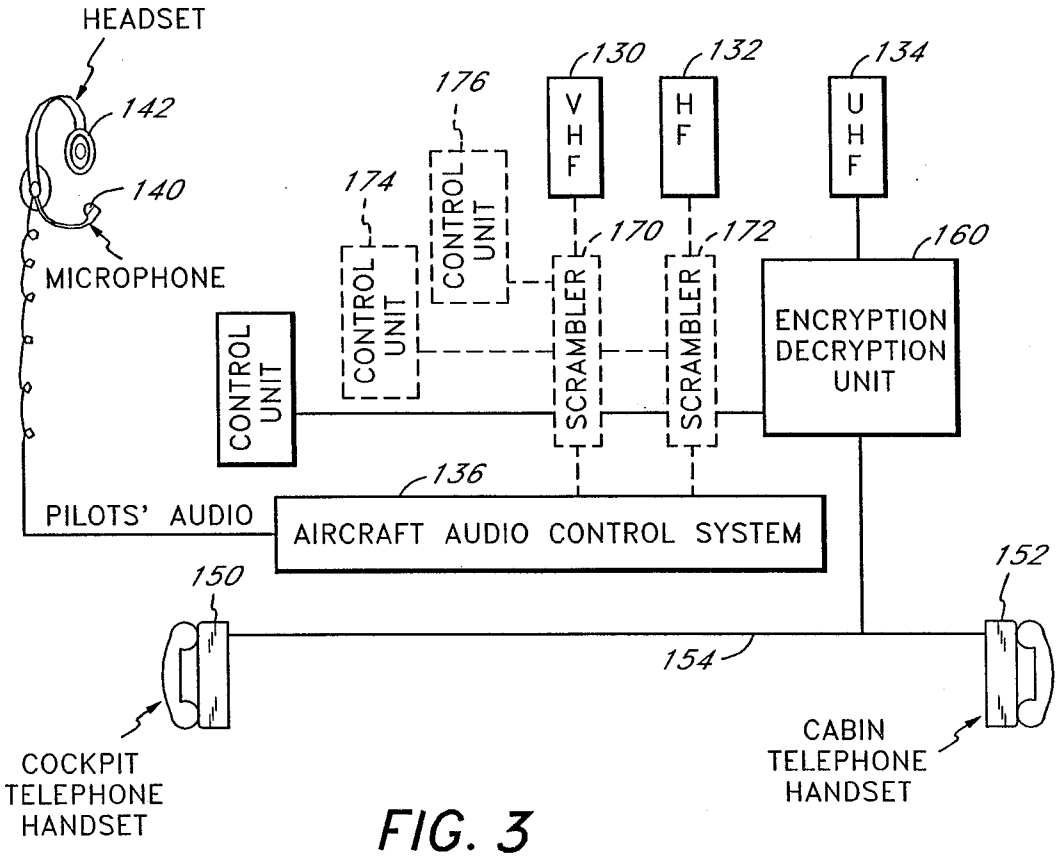
FIG. 3 shows the conventional wiring solution for protection of an airborne radio with only one point control and clear audio undesirably shared in common between cockpit and cabin.

Also shown in FIGS. 2 and 3 are a cockpit telephone handset 150 and a cabin telephone handset 152 which are typically the preferred form of communication via the UHF transceiver 134. As illustrated, the two handsets are typically wired in common via an audio bus 154 to provide communication between the cockpit 122 and the cabin 124 as well as to provide persons in both areas with access to the UHF transceiver 134. In order to avoid the interception of intelligible communications from the aircraft 100 to the ground, the audio bus 154 is routed through a scrambler unit 160 to the UHF transceiver 134. The scrambler unit 160 is controlled by a control unit 162 which typically is located in the cockpit 122 where it may be controlled by the pilot or other member of the flight crew.

In addition to the scrambler 160, the communication system of FIG. 3 may include additional scrambler units 170 and 172 (shown in phantom) that are positioned in the audio paths to and from the VHF transceiver 130 and the HF transceiver 132, respectively, each having a respective control unit 174 and 176.

Although the communication system illustrated in FIG. 3 will serve to scramble and protect communications between the aircraft 100 and the ground, it does not provide sufficient security for extremely sensitive communications. As illustrated, the audio bus 154 and the scrambler unit 160 are shared in common between the cockpit handset !50 and the cabin handset 152. Thus, the pilot or other crew member can eavesdrop on the unscrambled portion of the communications between a cabin passenger and the ground. Thus, a need exists for a system in which the cabin communication is secure even from the flight crew while maintaininq the flexibility of allowing the flight crew to utilize the scrambler unit 160 for sensitive communications regarding destinations and arrival times. Although one solution would be to include an additional scrambler unit dedicated to the cabin handset 152, this solution carries with it the cost and weight penalties of the extra scrambler unit plus the substantial likelihood that scrambler dedicated to the cockpit handset 150 would not be utilized sufficiently often to justify either the cost or the additional weight. Thus, there is a need to utilize one scrambler unit to serve both the cockpit handset 150 and the cabin handset 152 while maintaining isolation between the unscrambled communications to and from the two handsets. Furthermore, it is desireable that the cockpit crew of the aircraft have the option of communicating over the VHF transceiver 130 or the HF transceiver 132 in an encrypted mode without requiring the installation of an additional scrambler unit to provide the encryption.

Figure 4:
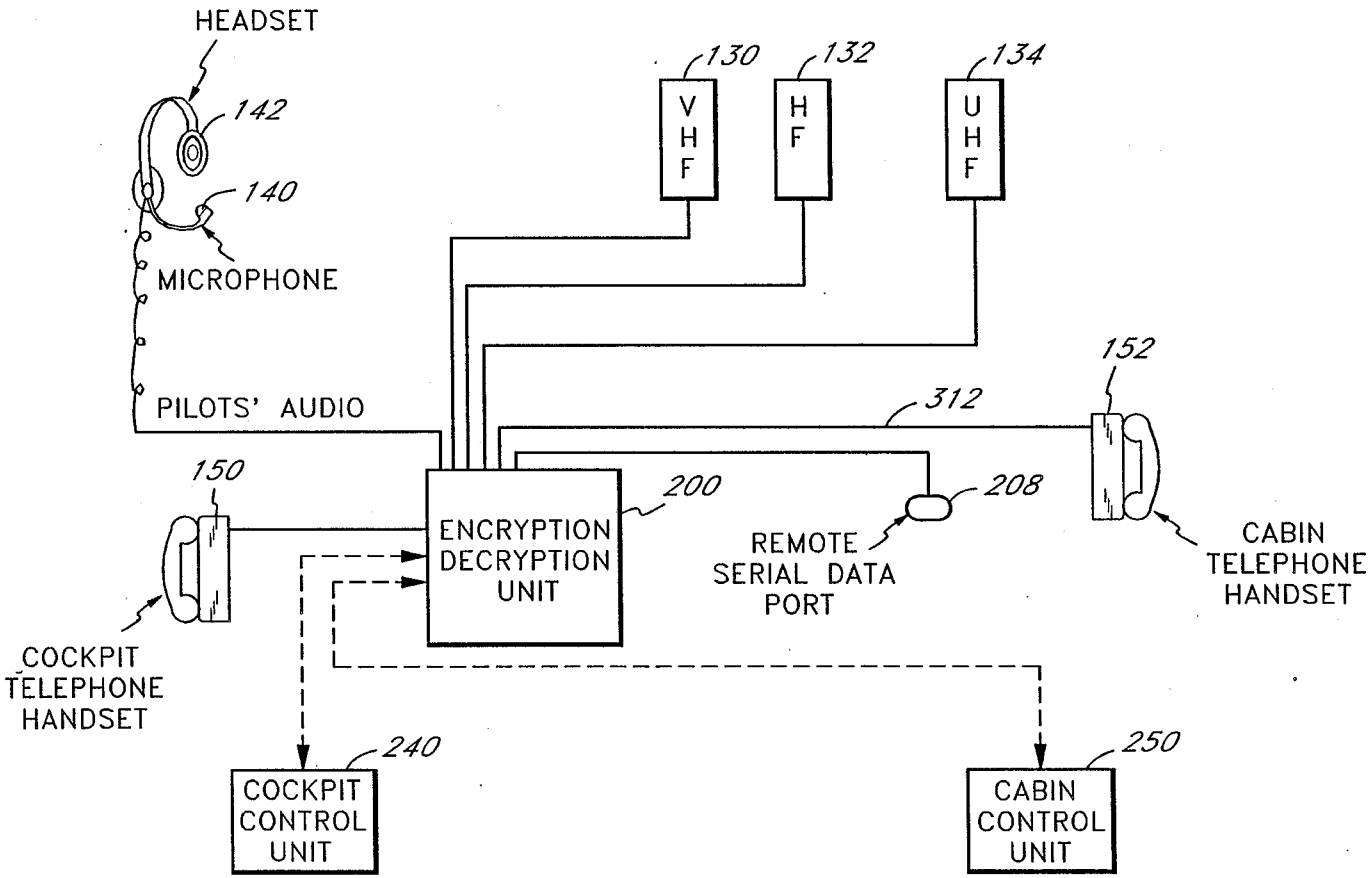
FIG. 4 shows the wiring solution of the present invention for multiple radios, independent users with crew selectable designation of the active controller, and isolated audio when in the ENCRYPTED mode.

Referring now to FIG. 4 and FIGS. **5*a*–5*e* and FIGS. 6–16, a typical interior arrangement is illustrated for the business aircraft 100 with the addition of a communication control system in accordance with the present invention control units installed in the cockpit 122 and in the cabin 124. As illustrated in FIG. 4, the communication system includes the VHF transceiver 130, the HF transceiver 132 and the UHF transceiver 134, as before. In addition, the communication system includes a single encryption/decryption unit 200. As will be discussed below, the encryption/decryption unit 200 includes an encryption/decryption module 202 (see FIGS. 6–16) that is controlled by a microprocessor 204 via a data and control link 206. In the exemplary embodiment of the invention described herein, the encryption/decryption module 202 is a commercially available Model VEM 1000 from Cycomm Corporation of Portland, Oreg. The VEM 1000 is a time domain multiplex unit which breaks one second blocks of speech (or digitally transmitted data) into 9–13 millisecond slices, and then rearranges and time compresses the slices for transmission according to an internal proprietary encryption scheme. The encryption/decryption module 202 attaches a digital "header" to each one second block of audio to provide, among other things, synchronization with the matching unit at the other end of the link (i.e., at the ground station 102 or the office 114 in FIG. 1). The selection of the VEM 1000 for the encryption/decryption module 202 is particularly advantageous because of the availability of a matching office model which can be connected directly to the public switched telephone network 112**. The use of the compatible ground unit provides the complete secure communication path from the airborne equipment to the selected ground station. It should be understood that other suitably packaged encryption or scrambler technology could be substituted.

The VEM 1000 used in the preferred embodiment of the encryption/decryption module 202 of the present invention includes the encryption circuitry and the decryption circuitry in the same unit and provides an input and an output port for encryption (i.e., to scramble the voice communication from the aircraft to ground) and an input and output port for decryption (i.e., to unscramble the voice communication from the ground to the aircraft). In the discussion of FIGS. 6–16 below, the encryption/decryption module will be referred to as the encryption module 202A when referring to the encryption circuitry in the transmission path and will be referred to as the decryption module 202B when referring to the decryption circuitry in the receive path. It should be understood that separate independent encryption and decryption modules can be substituted for the combined encryption/decryption module 202 of the preferred embodiment. In the embodiment described herein, the encryption/decryption module 202 operates in only one of its two modes at any one time. In other words, the encryption/decryption module 202 will either be encrypting a transmitted voice communication or decrypting a received voice communication. The push-to-talk switches on the cockpit microphone 140 and the cockpit and cabin telephone handset 150 and 152 are wired through the microprocessor 204 to control whether the encryption/ decryption module 202 is encrypting (when the push-to-talk switch is pushed) or decrypting (when the push-to-talk switch is released). It should be understood that the cockpit and cabin telephone handsets are operated in the push-to-talk mode rather than the full-duplex mode when the conversations are being encrypted.

Figure 6:
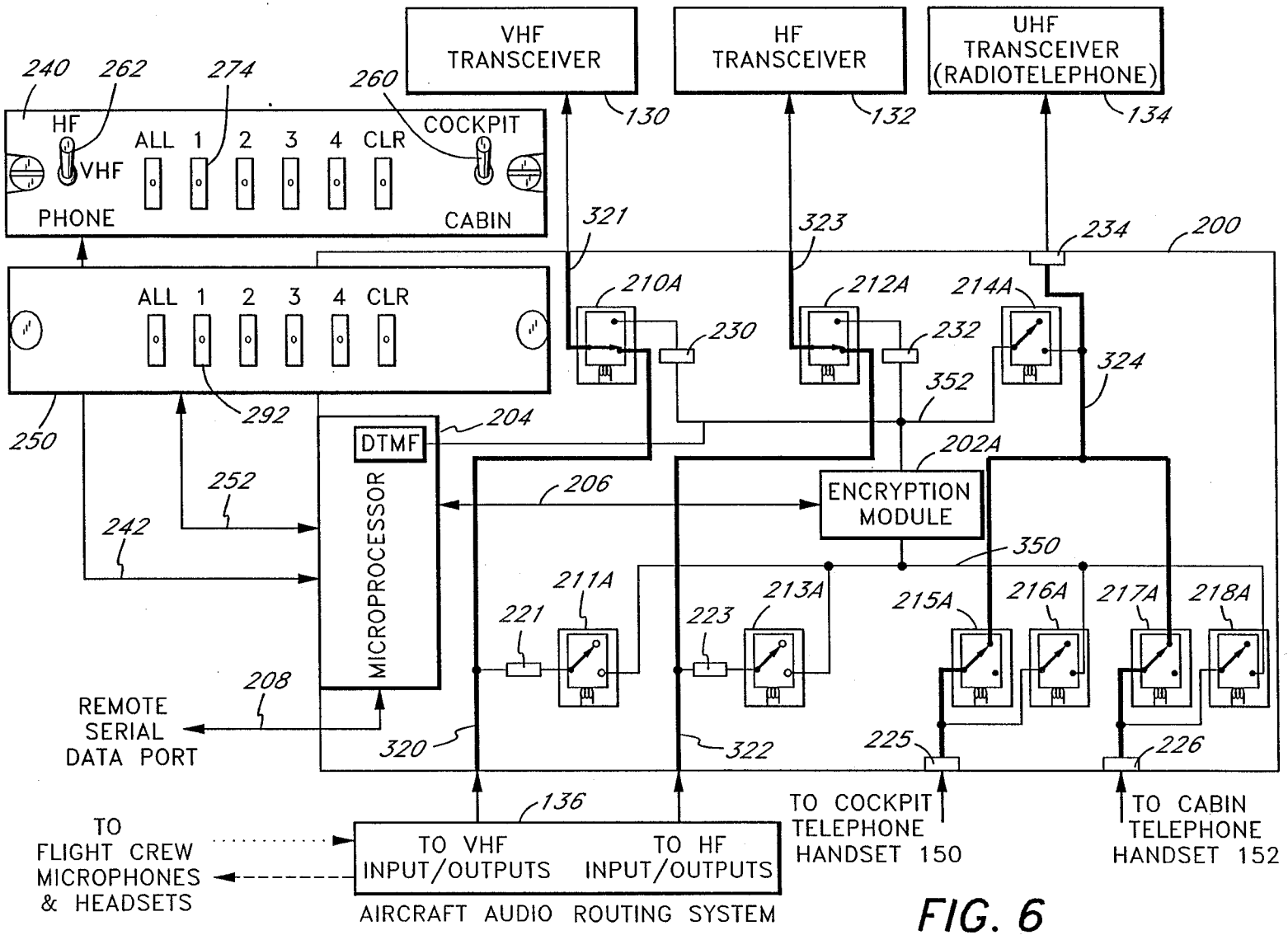
FIG. 6 shows a block diagram of the transmit audio paths through the encryption/decryption unit when in the CLEAR mode.

In the preferred embodiment, the data and control link 206 is an asynchronous data link that operates in accordance with the Electronic Industry Association (EIA) standard RS-232C standard. As set forth above, the data and control link 206 is used by the microprocessor 204 to communicate with the encryption/decryption module 202. The communication functions of the data and control link 206 include transmission of commands to control the encryption mode and key selection of the encryption/decryption module 202, the transmission of response and status from the encryption/decryption module 202 to the microprocessor 204, and the transmission of digital data to and from a selected transceiver through the encryption/decryption module 202. In the latter case, the microprocessor 204 serves as a traffic director by exchanging data with sources in the aircraft cabin, establishing a channel through the appropriate transceiver and controlling encryption. For example, referring to FIG. 4, in particular, the present invention preferably includes a serial data port 208 that is connected to the encryption/decryption unit 200 and thus to the microprocessor 204 (FIG. 6). An on-board computer (not shown), such as one of the many commercially available laptop computers, is connectable to the serial data port 208 to provide communication between the laptop computer and a computer on the ground via a selected transceiver.

When the laptop computer is used, the microprocessor 204 sets the channel through the UHF radiotelephone. The microprocessor advantageously includes a conventional Dual Tone Multifrequency (DTMF) Generator to dial the telephone number of a ground-based host computer. The host computer need only be connected through a matching VEM 1000 telephone unit loaded with encryption keys (codes) matching those in the encryption/decryption module 202. After auto answer n the ground, the microprocessor 204 signals the on-board laptop computer to transmit data, and then monitors the link through completion at which time it "hangs up" or terminates the link.

Referring again to FIGS. 6 and 7, the encryption/decryption unit 200 includes an electronic switching network that comprises a plurality of relays 210A and 210B, 211A and 211B, 212A and 212B, 213A and 213B, 214A and 214B, 215A and 215B, 216A and 216B, 217A and 217B, and 218A and 218B. As discussed above with respect to the encryption/decryption module 202, the relays with the "A" designations are in the transmission paths (FIGS. 6, 8, 10, 12 and 14) and the relays with the B designations of are in the receive paths (FIGS. 7, 9, 11, 13 and 15). The A and B relays could be poles of a double-pole relay, or, as in the preferred embodiment, separate relays that are energized at the same time. Furthermore, although drawn as conventional coil-type relays, the relays can advantageously be other types of relays or semiconductor switches. The relays are selectively activated to route audio communication sources and destinations to and from the encryption/decryption module 202. The operation of the relays in the electronic switching network will be discussed in more detail below.

The encryption/decryption unit 200 further includes a plurality of input signal conditioning circuits 220, 221, 222, 223, 224, 225 and 226 that operate in a conventional manner to provide voltage level conversion and impedance matching to convert signals from the audio sources (i.e., the microphones, the handsets and the audio outputs of the radio receivers) to signals compatible with the input to the encryption/decryption module 202, and a plurality of output signal conditioning circuits 230, 231, 232, 233, 234, 235 and 236 that operate to convert signals from the encryption/decryption module 202 and from the input signal conditioning circuits 220–226 to signals compatible with the audio output devices (i.e., the headphones, the handset, and the audio inputs to the transceivers). As will be discussed below, the input and output signal conditioning circuits for the VHF and HF signal paths are bypassed in the clear (un-encrypted mode) so that the VHF and HF paths from the aircraft audio routing system 136 are connected directly to the respective transceivers in the un-encrypted mode.

As further illustrated in FIGS. 4, 5*a*, 5*b* and 5*c*, and 6–15, the communication system of the present invention includes a cockpit control unit 240, that is preferably located adjacent (e.g., beneath) the cockpit handset 150 so that it is readily accessible by a member of the flight crew. The cockpit control unit 240 includes a plurality of switches that are electrically connected to the microprocessor 204 by signal wiring 242 (FIGS. 6–15) to enable a member of the cockpit crew to control the microprocessor 204 and thus control the encryption unit 200.

Figures 5A, 5B, 5C, 5D, 5E:
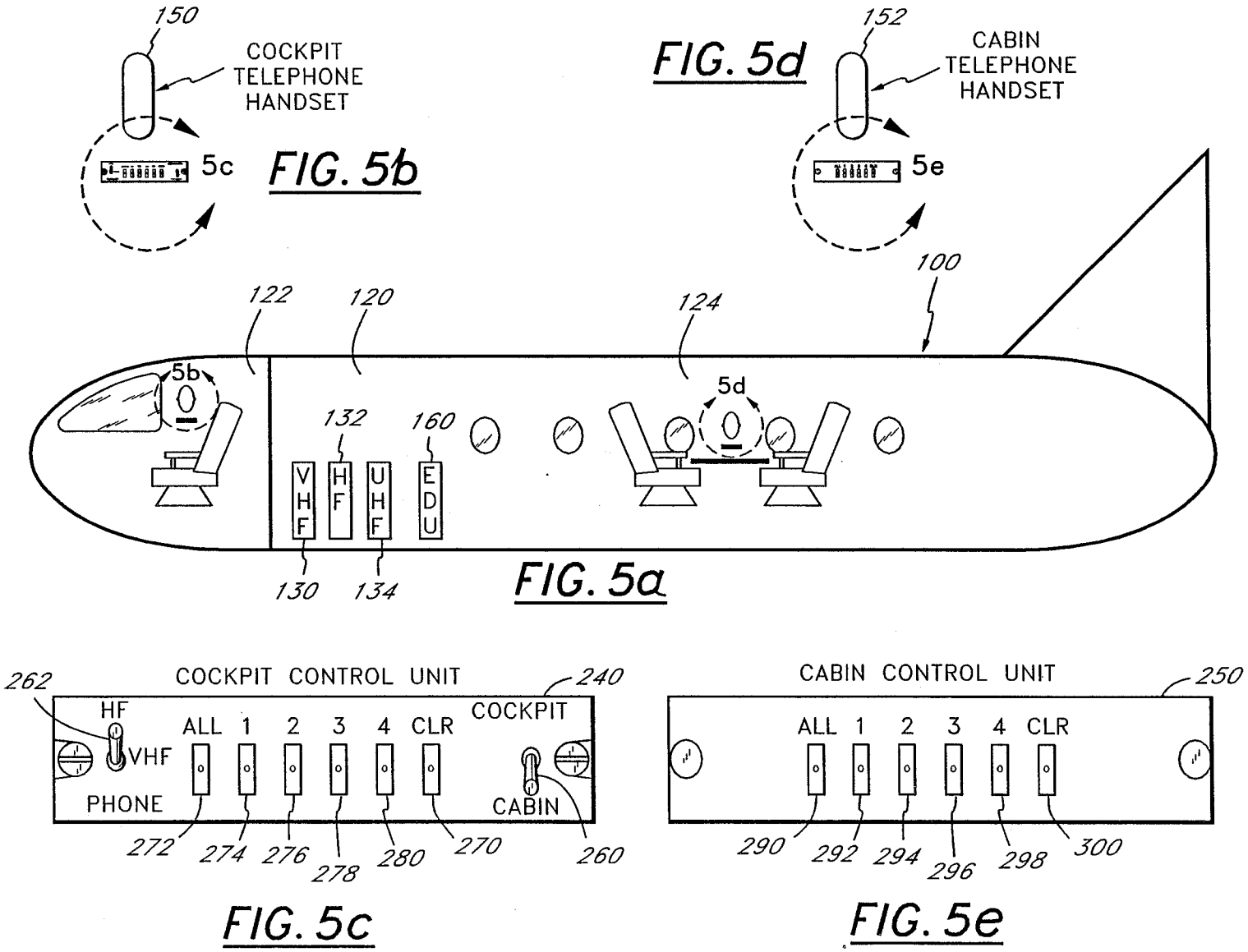
FIG. 5*a* illustrates typical locations of an exemplary business aircraft with the control units of the present invention installed for use by the cockpit crew and the passengers.
FIG. 5*b* is an enlarged view of the cockpit radiotelephone handset with the cockpit control unit positioned proximate thereto.
FIG. 5*c* is a further enlarged view of the panel of the cockpit control unit showing the control switches positioned thereon.
FIG. 5*d* is an enlarged view of the cabin radiotelephone handset with the cabin control unit positioned proximate thereto.
FIG. 5*e* is a further enlarged view of the panel of the cabin control unit showing the control switches positioned thereon.

As further illustrated in FIGS. 5*d* and 5*e*, a cabin control unit 250 is provided in the cabin 124 proximate to the cabin handset 152. The cabin control unit 250 also includes a plurality of switches connected to the microprocessor 206 via signal wiring 252 (FIGS. 6–15) which enable the passenger in the cabin 124 to control the operation of the encryption unit 200. In the embodiment illustrated herein, the cabin control unit 250 is subordinate to the cockpit control unit 240 with respect to the control of the encryption unit 200; however, as will be discussed below, such subordination does not lessen the communication security provided to the cabin passenger.

Referring now to the enlarged illustration of the cockpit control unit 240 in FIG. 5*c*, it can be seen that the cockpit control unit 240 includes a controller selector switch (CSS) 260, a radio selector switch (RSS) 262, and six encryption control push-button switches 270, 272, 274, 276, 278 and 280. The controller selector switch 260 has two positions, one of which is labelled "COCKPIT" and the other of which is labelled "CABIN". When the controller selector switch 260 is the cockpit position, the encryption control switches (discussed below) on the cockpit control unit 240 are enabled to further control the microprocessor 204. On the other hand, when the controller selector switch 260 is in the CABIN position, the encryption control switches on the cabin control unit 250 is enabled to control the microprocessor 204, as will be discussed below.

The radio selector switch on the cockpit control unit 240 is always activated irrespective of the position of the controller selector switch 260. The radio selector switch 262 has three positions labelled as "HF", corresponding to the HF transceiver 132, "VHF", corresponding to the VHF transceiver 130, and "PHONE", corresponding to the UHF transceiver 134. The radio selector switch 262 determines which of the three transceivers is to be used for encrypted communication. As will be discussed below, the radio selector switch 262 does not affect the unencrypted communications by the cockpit crew members.

The first encryption control pushbutton switch 270 on the cockpit control unit 240 is labelled as "CLR". When the first pushbutton switch 270 is activated while the cockpit control unit 240 is enabled, the microprocessor 204 responds by removing the encryption module 202 from the audio paths to and from the cockpit communication devices (i.e., the microphone 140, the headset 142 and the cockpit handset 150), irrespective of the position of the radio selector switch 262. Thus, the communications to and from the cockpit crew and the passenger cabin will be "clear" (i.e., unencrypted) as is necessary for normal air to ground communications, such as to an air traffic control center or tower. (In the preferred embodiment described herein, the audio paths to and from the cabin handset 152 are automatically disabled or placed in the clear transmission mode when the cockpit control unit 240 is enabled.) In the preferred embodiment, the microprocessor 204 is programmed to include an initialization routine that has instructions to cause the communication system of the present invention to be initially enabled in the clear mode so that there are no inadvertent transmissions of data in the encrypted mode. The microprocessor is further programmed to automatically return the communication system to the clear mode when the radio selector switch 262 is switched from one position to another position so that a crew member communicating in the encrypted mode on the HF transceiver 132, for example, does not switch over to the FAA control center via the VHF transceiver 130, for example, and inadvertently continue transmitting and receiving in the encrypted mode. The first pushbutton 270 preferably includes a light source that is selectively activated by the microprocessor 204 to indicate when the communication system is in the clear mode. In preferred embodiments of the present invention, the switch 270 is a momentary type pushbutton, and the light source is an LED that is included as part of the switch assembly, thus saving room on the cockpit control unit 240.

The second pushbutton switch 272 on the cockpit control unit is labelled "ALL"; the third pushbutton switch 274 is labelled "1"; the fourth pushbutton switch 276 is labelled "2"; the fifth pushbutton switch 278 is labelled "3"; and the sixth pushbutton switch 280, labelled "5". One switch of this group of five encryption switches can be enabled in the encryption mode to select an encryption key to be used by the encryption module 202. Thus, for example, when the third pushbutton switch 274 ("1") is activated, the microprocessor 204 issues commands to the encryption module 202 to cause the encryption module 202 to scramble the data in accordance with a first encryption key. Similarly, activation of one of the fourth pushbutton switch 276 ("2"), the fifth pushbutton switch 278 ("3") or the third pushbutton switch 280 ("4") will cause the encryption module 202 to scramble the voice transmission in accordance with a second, third, or fourth key, respectively. The second pushbutton switch 272 ("ALL") causes the microprocessor 204 to cause the encryption module 202 to encrypt and decrypt the voice communication in accordance with a fifth key, identical in all characteristics to the other four keys, but labelled as "ALL" to suggest distribution to, and use by, "all" members of the user organization. Each of the second, third, fourth, fifth and sixth switches preferably includes a light source (e.g., preferably an internal LED) that is activated by the microprocessor 204 to indicate that encryption module 202 has been introduced into the selected audio path (i.e., HF, VHF or PHONE) and that the selected encryption key or keys have been enabled.

On initialization, the light in the CLR (clear) pushbutton switch 270 of the active control unit is turned on by the microprocessor 204 to signify successful self-test and setup of clear channel audio paths requested by the radio selector switch 262 and the controller selector switch 260. Preferably, this initialization feature occurs whenever power is applied to the 28 VDC electrical bus of the aircraft 100. When an encryption switch (ALL, 1, 2, 3, or 4) is pushed, its LED is turned on to signify that the appropriate audio paths have been set and the encryption unit is responding with the proper encryption key. In the present embodiment, each of the encryption control keys are equivalent in function and differ only in name of the software key (or code) to be used by the encryption/decryption module 202. In the encrypted mode, the audio paths determined by the positions of the radio selector switch 262 and the controller selector switch 260 do not change with the selection of one of the encryption switches, and the audio path routing is changed only by pressing the CLR (clear) button, as discussed above. Once an encryption button other than CLR has been pushed, the only element in the system which changes is the key utilized by the encryption/decryption module 202 for audio or data transmitted through it. This key is selected by 5 issuing a specific command from the microprocessor 204 to the encryption/decryption module 202 over the RS-232C data and control link 206 described above.

The cabin control unit 250 is similar to the cockpit control unit 240 and includes six encryption control pushbutton switches 290, 292, 294, 296, 298 and 300. However, as set forth above, in the preferred embodiment described herein, the cabin control unit 250 is subordinate to the cockpit control unit 240 and is only enabled when the controller selector switch 260 of the cockpit control unit 240 is in the CABIN position. Thus, the cabin control unit 250 does not include a controller selector switch. In most cases, there is little if any need for a cabin passenger to engage in a scrambled communication over either the HF transceiver 132 or the VHF transceiver 130. Further, those transceivers generally need to be controlled by the cockpit crew to maintain air to ground communications with air traffic controllers or for use in navigation. Thus, the exemplary cabin control unit 250 does not include a radio selector switch.

The six encryption control switches on the cabin control unit 250 include the first pushbutton switch 290, labelled "ALL"; the second pushbutton switch 292, labelled "1"; the third pushbutton switch 294, labelled "2"; the fourth pushbutton switch 296, labelled "3"; the fifth pushbutton switch 298, labelled "4"; and the sixth pushbutton switch 300, labelled "CLR". Each of these switches is enabled when the cabin control unit 250 is enabled by the CABIN position of the controller selector switch 260. When a particular switch of the cabin control unit 250 is activated, the microprocessor 204 responds as discussed above to selectively route the audio paths between the cabin handset 152 and the UHF transceiver 134 through the encryption/decryption module 202. Thus, but for the transceiver selection, a cabin passenger has control over the operation of the encryption/decryption module 202 in the same manner as the cockpit crew does when the cockpit control unit 240 is enabled. Passengers located in the cabin 124 communicate over the handset 152 and may place their own calls in a conventional manner or rely on the crew to initiate the call. Irrespective of the manner in which the call is placed, the cabin control unit 250 provides the passenger with a means of selecting the desired encryption mode for the UHF radiotelephone when the flight crew selects the cabin control unit 250 as the active unit via the controller selector switch 260.

As set forth above, the controller selector switch 260 on the cockpit control unit 240 determines which of the control units 240 or 250 controls the operation of the encryption/decryption unit 200. In the preferred embodiment described herein, ground lines from each of the two control units are routed to respective switched contacts on the controller selector switch 260. The common contact of the controller selector switch 260 is connected to ground so that ground connection of the control unit corresponding to the current position of the controller selector switch 260 is connected to ground through the controller selector switch 260, and the ground connection of the other control unit is open. Each of the other switches and the corresponding indicator lights on the two control units is connected to the respective ground of the control unit so that they are operational only when the ground connection of the control unit is completed through the controller selector switch 260. Thus, when the controller selector switch 260 is in the COCKPIT position, the ground connection is completed for the switches and indicators on the cockpit control unit 240 and disconnected from the cabin control unit 250. Therefore, when a crew member pushes a pushbutton on the cockpit control unit 240, a ground connection is completed through that switch to cause a change of signal level on a line from the switch to the microprocessor 204. The change in signal level is detectable by the microprocessor 204 which activates the indicator associated with the switch, activates the encryption/decryption module 202 with the selected key or keys, and routes the selected audio path through the encryption/decryption module 202. At the same time, the attempted activation of a switch on the cabin control unit 250 has no effect since there is no ground connection that can be completed by pressing the switch. Similarly, the output signals from the microprocessor 204 cannot activate an indicator on the cabin control unit 250 since there is no ground connection to complete the current path to the indicator. Conversely, when the controller selector switch 260 is moved to the CABIN position, the ground connection to the cabin control unit 250 is completed and the ground connection to the cockpit control unit 240 is disconnected so that the indicators and switches on the cabin control unit 250 are enabled and the indicators and switches on the cockpit control unit 240 are disabled.

As set forth above, the present invention is used in conjunction with the existing aircraft radio system. Thus, the existing aircraft audio routing system 136 will continue to be used by the cockpit crew to select which of the VHF and HF transceivers are being used for voice communications. The encryption/decryption unit 200 is interposed between the audio routing system and the selected transceivers so that the audio paths to the transceivers can be selectively encrypted, as discussed above. For example, in some aircraft, the installation of the present invention may be as simple as cutting existing wiring between the aircraft audio routing system and splicing the encryption/decryption unit 200 in series into each respective aircraft circuit.

As illustrated in FIG. 4, the cockpit handset 150 and the cabin handset 152 are interconnected with the encryption unit 200 via separate audio paths. The cockpit handset 150 is connected to the encryption/decryption unit 200 via an audio path 310 and the cabin handset 152 is connected to the encryption/decryption unit 200 Via an audio path 312. There is no direct connection between the two audio paths other than as may be provided by the encryption/decryption unit 200, as will be described below. Thus, the cabin communications are isolated from the cockpit handset 150 and the cockpit communications are isolated from the cabin handset 152. When the clear transmission mode is selected on the control unit currently having control of the encryption/decryption unit 200, the audio paths from the two handsets are connected in parallel within the encryption/decryption unit 200 so that the two handsets can be used at the same time to communicate through the UHF transceiver 134 and to provide communication between the cockpit handset 150 and the cabin handset 124. On the other hand, when the encryption mode is selected by enabling one of the pushbuttons ALL, 1, 2, 3 or 4 on the currently enabled control unit 240 or 250, the microprocessor 204 within the encryption/decryption unit 200 routes the audio path from the handset corresponding to the active control unit through the encryption/decryption module 202 and disconnects the audio path from the handset corresponding to the inactive control unit. This operation assures the privacy of the conversation within the aircraft itself since the clear (i.e., unscrambled) audio from the active handset is routed only to the encryption/decryption unit 200 and not to the other handset.

As will be shown below with respect to FIG. 16, the requirement for isolation of on-board audio between the cockpit 122 and the cabin 124 is automatically implemented whenever the PHONE (UHF) is selected and the encryption mode is commanded by the enabled control unit 240 or 250. Only the audio associated with the enabled control unit will be enabled. Should a crew member deliberately or accidentally toggle the controller selector switch 260 from one position to the other, the audio is automatically terminated to the originally selected location so that no possibility exists for one party to listen in on the other. Although the party originally engaged in an encrypted conversation will incur the inconvenience of an interrupted conversation, such inconvenience is preferable to the loss of security to an accidental or deliberate eavesdropper.

In the presently preferred embodiment of the invention, the encryption/decryption unit 200, including the encryption/decryption module 202, the microprocessor 204, the relays 210–218, and the input and output signal conditioning input circuits 220–226 and 230–236 are housed within a conventional ⅜ ATR (Air Transport Racking) size, approximately 12 inches deep, 10 inches high, and 5 inches wide. It is connected to the aircraft wiring via an ITT Cannon DPXBMA-A106-34S-0001 rack mounted connector. The entire assembly, including rack, weighs approximately 7.5 pounds. Power is derived from the standard existing aircraft 28 volt DC electrical bus feeding other aircraft electronics and requires less than 2 amperes of current (i.e., the unit has a power consumption of less than 50 watts).

The cockpit control unit 240 fastens into the aircraft control console, or other suitable location, with conventional twist (DZUS) aircraft fasteners. The cockpit control unit 240 is approximately 1 inch high by 4.5 inches wide by 2.5 inches deep and is thus comparable in size to commercially available aircraft communication equipment. It uses a back lighted plastic faceplate for night operation from standard aircraft electrical lighting buses (5 and 28 volt DC) and is connected into the system wiring using an industry standard Miniature Sub-D 25 pin connector.

As set forth above, the radio selector switch 262 on the cockpit control unit 240 is a three-position latching toggle switch which physically displays the current transceiver selection. The radio selector switch 262 determines the routing of audio from the selected transceiver through the encryption/decryption module 202 and thus to the aircraft audio paths. The flight crew has exclusive control over the HF transceiver 130 and the VHF transceiver 132 and no request from the cabin control unit 250 is recognized when the radio selector switch 262 is in either the VHF or the HF position.

Another important protective feature of the preferred embodiment of the present invention is the generation of an automatic command to the microprocessor 204 to return the encryption/decryption unit 200 to the Clear operation mode whenever the radio selector switch 262 is moved to a new position. This feature eliminates the possibility of unintentionally encrypting transmissions on a different transceiver should the radio selector switch 262 be bumped or moved while transmitting encrypted on the originally selected transceiver.

General Description of FIGS. 6–15

FIGS. 6–15 are block diagram representations of the encryption/decryption unit 200 and serve to illustrate the different routings of audio through the unit for each of the different positions of the radio selector switch 262 and the controller selector switch 260 and for the encrypted and clear modes. For ease of understanding the different audio paths, FIGS. 6, 8, 10, 12 and 14 represent paths of audio generated on board the aircraft 100 at a microphone or handset to be transmitted by the selected transceivers, and FIGS. 7, 9, 11, 13 and 15 represent paths of audio received from the selected transceivers and directed to a headphone of handset.

As set forth above, the routing of the audio signals through the encryption/decryption unit 200 is determined by the operation of the relays 210–218. Each of the relays 210–218 is shown as a relay pair, with an A designation corresponding to the relay of the pair in a transmit path in FIGS. 6, 8, 10, 12 and 14, and a B designation corresponding to the relay in a pair in a receive path in FIGS. 7, 9, 11, 13 and 15. As discussed above, the two relays in a pair may be two individual relays that are activated at the same time or two poles of a double-pole relay. Although the operation of the relays and thus the various switching functions could be controlled directly by the switches on the cockpit control unit 240 and the cabin control unit 250, in the preferred embodiment of the invention described herein, the microprocessor 204 is programmed to continuously sample the positions of the various switches on the two control units (i.e., the radio selector switch 262, the control selector switch 260, and the encryption control switches 270, 272, 274, 276, 278, 280) and to control the relays by issuing output signals to the relays in response to the sensed positions of the switches. Relays that are controllable by output signals from microprocessors are known to the art. For example, the relays are advantageously commercially available relays. Some of the relays have a set of normally closed contacts that are connected in the unenergized state of the respective relay and open when the relay is energized. Other relays have a set of normally open contacts that are connected only in the energized state of the respective relay. Other relays are double-throw relays having a set of normally closed contacts and a set of normally open contacts for the same pole of the relay. The control signal lines from the microprocessor 204 to the relays are not shown in the figures as the connection and operations of such lines is well within the knowledge of one skilled in the art.

The audio paths between the cockpit or cabin user and the selected transceiver are selected in accordance with the positions of the contacts of the relays 210–218 as determined by the output signals generated by the microprocessor 204. In general, each channel requires only two such relays to selectively interpose the encryption/ decryption module 202 into series with the audio path between the user and a selected transceiver. However, because of the requirement for further isolation of UHF (i.e., PHONE) audio between the cabin 124 and the cockpit 122, the UHF channel requires additional relays, as will be discussed below in connection with connection with FIGS. 12–15. In the preferred embodiment, the relays are controlled by specific output signals from the microprocessor. In each of FIGS. 6–15, the audio paths being discussed in connection with a particular figure are emphasized with bold lines to make the paths more readily identifiable.

Figure 7:
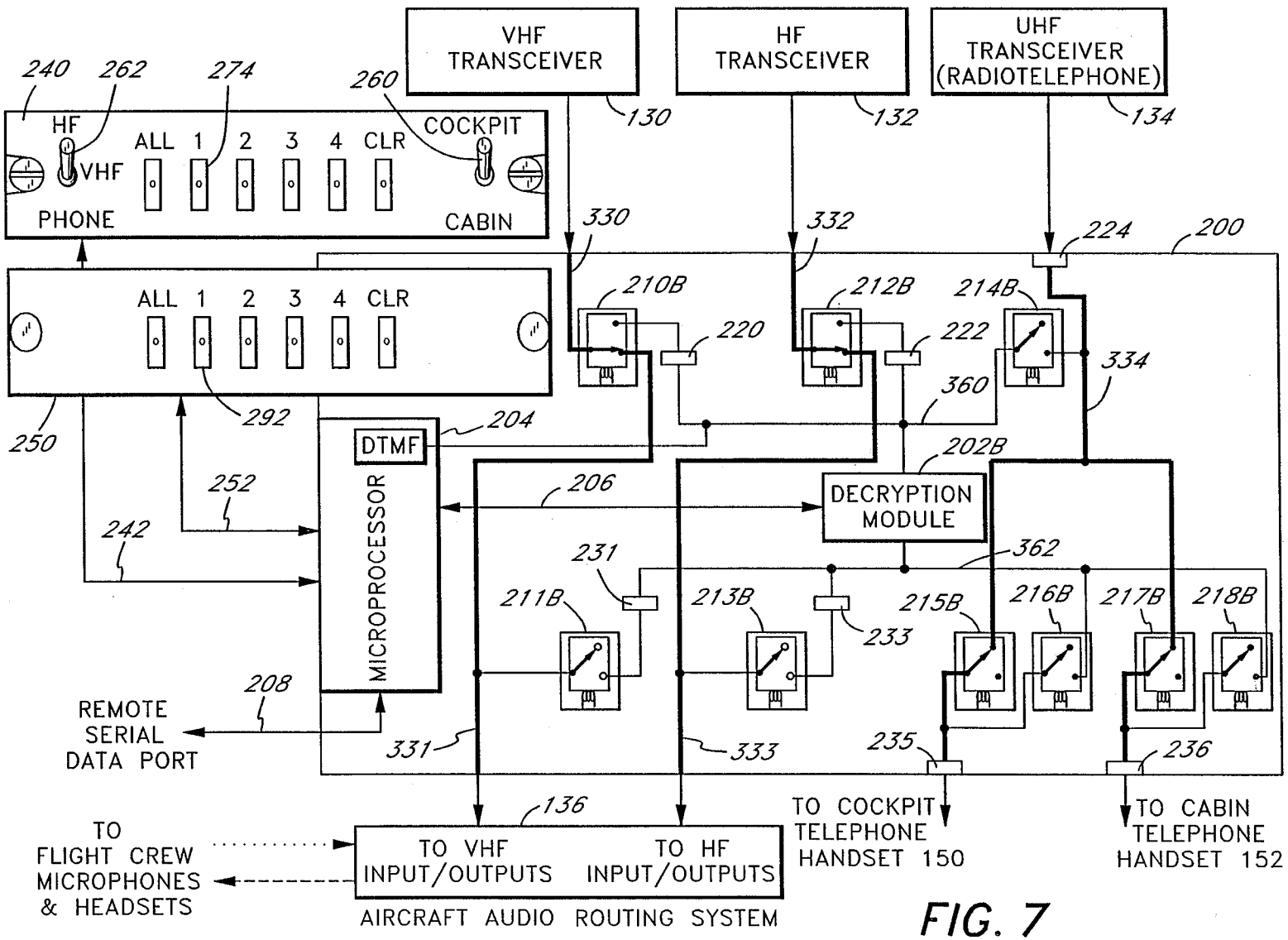
FIG. 7 shows a block diagram of the receive audio paths through the encryption/decryption unit when in the CLEAR mode.

Detailed Description of the Clear Mode Audio Paths of FIGS. 6 and 7

Referring now to FIG. 6 in particular, the transmission paths for the encryption/decryption unit 200 are illustrated for the condition when the active control unit is in the clear mode. All the relays 210–218 are shown in their unenergized states with an electrical connection through the normally closed contacts of each relay and no electrical connection through the normally open contacts. That is, the connections shown in FIG. 6 are those that occur when no power is applied to the coils of the relays. Since the clear mode is likely to be the most frequently occurring mode, this is a particularly advantageous feature because the circuit does not require the power to energize a coil to maintain this mode. Furthermore, in the VHF and HF paths, an electrical connection is completed between the aircraft audio routing system 136 and the respective transceivers irrespective of whether power is applied to the encryption/decryption unit 200. Thus, in the event of a power failure to the encryption/decryption unit 200, such as may happen if a fuse blows or a circuit breaker trips, an operational electrical path is provided to each of the two transceivers that are most frequently used for aircraft communication and navigation.

As illustrated in FIG. 6, beginning at the bottom of the figure, the VHF microphone audio signal from the aircraft audio routing system 136 enters the VHF transmit path input of the encryption/decryption unit 200 via a signal line 320 and is routed to the input of the VHF transmit path input signal conditioning circuit 221 and to the normally closed contact of the relay 210A. The common contact of the relay 210A is connected via a signal line 321 to the VHF transmit path output and is thus connected to the audio input of the VHF transceiver 130. Thus, it can be seen that a complete electrical path is provided from the VHF transmit path input to the VHF transmit path output via the signal line 320, the relay 210A and the signal line 321. On the other hand, the normally open relay contacts of the relay 211A prevent the VHF microphone audio signal from reaching the encryption module 202A; and the normally open contacts of the relay 210A prevent any signal output from the encryption module 202A from being connected to the signal line 321. Since the VHF transmit path created by the configuration illustrated in FIG. 6 requires no energization of either the relay 210A, the relay 211A, the VHF transmit path input signal conditioning circuit 221 or the VHF transmit path output signal conditioning circuit 230, this is the VHF transmit path that will be provided in the event of a power failure to the encryption/decryption unit 200.

As further illustrated in FIG. 6, again beginning at the bottom of the figure, the HF microphone audio signal from th aircraft audio routing system 136 enters the HF transmit path input of the encryption/decryption unit 200 via a signal line 322 and is routed to the input of the HF transmit pat input signal conditioning circuit 223 and to the normally closed contact of the relay 212A. The common contact of the relay 212A is connected via a signal line 323 to the HF transmit path output and is thus connected to the audio input of the HF transceiver 132. Thus, it can be seen that a complete electrical path is provided from the HF transmit path input to the HF transmit path output via the signal line 322, the relay 212A. and the signal line 323. On the other hand, the normally open relay contacts of the relay 213A prevent the HF microphone audio signal fro reaching the encryption module 202A; and the normally open contacts of the relay 212A prevent any output signal from the encryption module 202A from being connected to the signal line 323. Since operation of the HF transmit path created by the configuration illustrated in FIG. 6 requires no energization of either the relay 212A, the relay 213A, the HF transmit path signal input conditioning circuit 223 or the HF transmit path output signal conditioning circuit 232, this is the HF transmit path that will be provided in the event of a power failure to the encryption/decryption unit 200.

Again, beginning at the bottom of FIG. 6, the audio directly from the cockpit telephone handset 150 enters the encryption/decryption unit 200 via the UHF cockpit transmit path input signal conditioning circuit 225 and passes through the normally closed contacts of the relay 215A to a signal line 324. In like manner, the audio directly from the cabin telephone handset 152 enters the encryption/ decryption unit 200 through the UHF cabin transmit path input signal conditioning circuit 226 and passes through the normally closed contacts of the relay 217A and to the signal line 324 where it joins the signal from the cockpit telephone handset 150. The signal line 324 bypasses the relay 214A and exits the encryption/decryption unit 200 via the UHF transmit path output signal conditioning circuit 234 to the audio input of the UHF transceiver 134.

FIG. 7 illustrates the corresponding VHF, HF and UHF receive paths for the clear mode which are analogous to the transmit paths. Again, all relays are shown in their unenergized states. Beginning at the top of the figure, the audio output from the VHF transceiver enters the encryption/decryption unit 200 via a signal line 330 and is connected to the common contact of the relay 210B. The audio output passes through the normally closed contact of the relay 210B to a signal line 331 and thus to the VHF receive path output of the encryption/decryption unit 200, which is connected to the aircraft audio routing system 136. The normally open contact of the relay 210B blocks the audio output on the line 330 from reaching the VHF receive path input signal conditioner 220 and thus prevents the signal from reaching the decryption module 202B. In like manner, the normally open contact of the relay 211B blocks any output from the decryption module from reaching the signal line 331. Thus, in this clear mode, the VHF receive path does not include the decryption module 202B, the VHF receive path input signal conditioning circuit 220 or the VHF receive path output signal conditioning circuit 231. Since the operation of this path requires no energization of the relay 210B, the relay 211B, the VHF receive path input signal conditioning circuit 220 or the VHF receive path output signal conditioning circuits 231, this is the VHF receive path that will be provided in the event of a power failure to the encryption/decryption unit 200.

Again, beginning at the top of FIG. 7, the audio output from the HF transceiver enters the encryption/decryption unit 200 via a signal line 332 and is connected to the common contact of the relay 212B. The audio output passes through the normally closed contact of the relay 212B to a signal line 333 and thus to the HF receive path output of the encryption/decryption unit 200, which is connected to the aircraft audio routing system 136. The normally open contact of the relay 212B blocks the audio output on the line 332 from reaching the HF receive path input signal conditioner 222 and thus prevents the signal from reaching the decryption module 202B. In like manner, the normally open contact of the relay 213B blocks any output from the decryption module from reaching the signal line 333. Thus, in this clear mode, the HF receive path does not include the decryption module 202B, the HF receive path input signal conditioning circuit 222 or the HF receive path output signal conditioning circuit 233. Since the operation of this path requires no energization of the relay 212B, the relay 213B, the HF receive path input signal conditioning circuit 222 or the HF receive path output signal conditioning circuits 233, this is the HF receive path that will be provided in the event of a power failure to the encryption/decryption unit 200.

As further illustrated in FIG. 7, the audio output by the UHF transceiver 134 enters the encryption/decryption unit 200 through the UHF receive path input signal conditioning circuit 224 and bypasses the normally open contacts of the relay 214B along a signal line 334. The signal line 334 provides the audio signal to the normally closed contacts of the relay 215B and to the normally closed contacts of the relay 217B. The relay 215B connects the audio signal to the UHF cockpit receive path output signal conditioning circuit 235 and thus to the earphone of the cockpit telephone handset 150. The relay 217B connects the audio signal to the UHF cabin receive path output signal conditioning circuit 236 and thus to the earphone of the cabin telephone handset 152.

Figure 8:
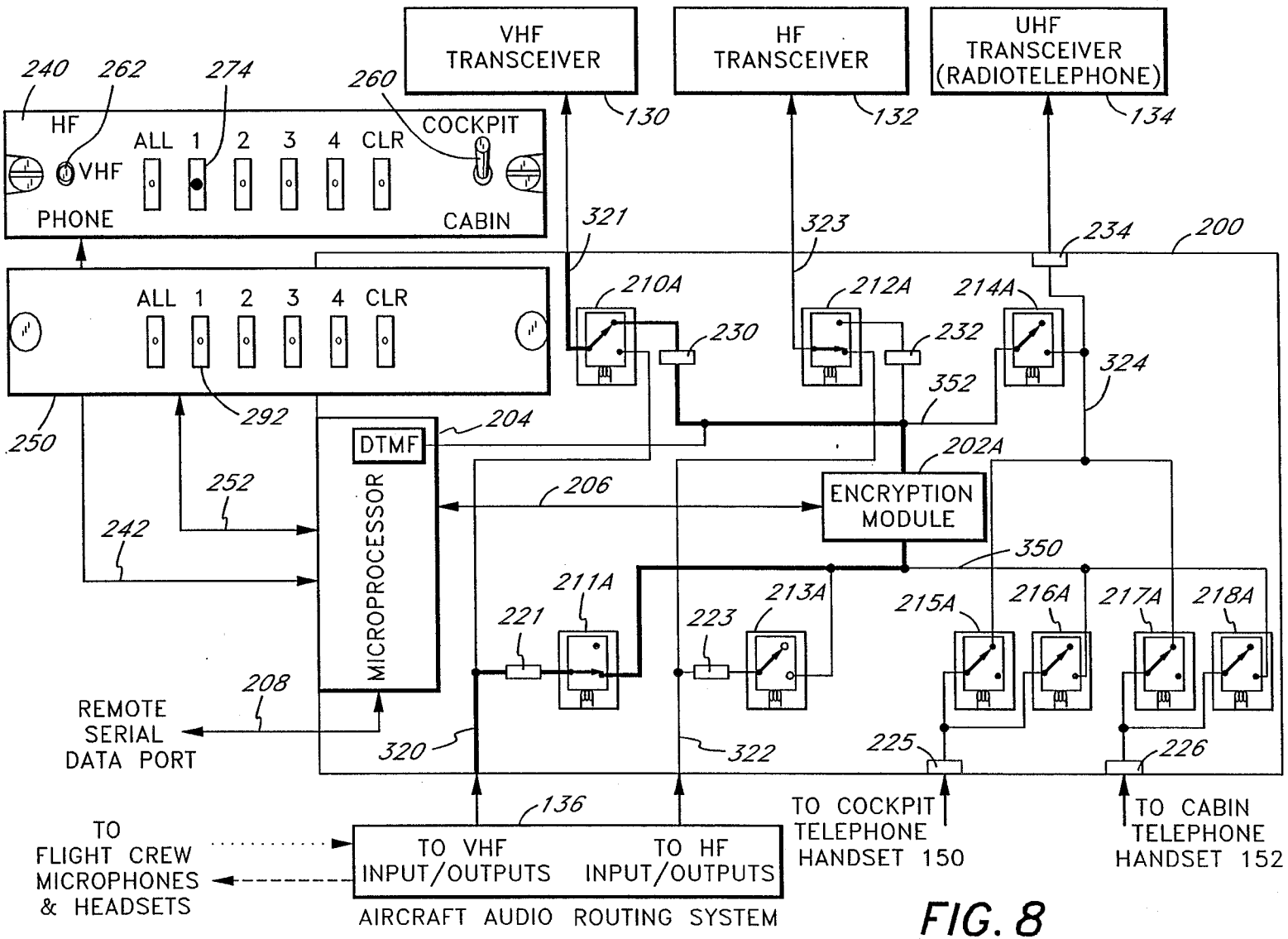
FIG. 8 shows a block diagram of the transmit audio path through the encryption/decryption unit for the VHF radio when in the ENCRYPTED mode.
Figure 9:
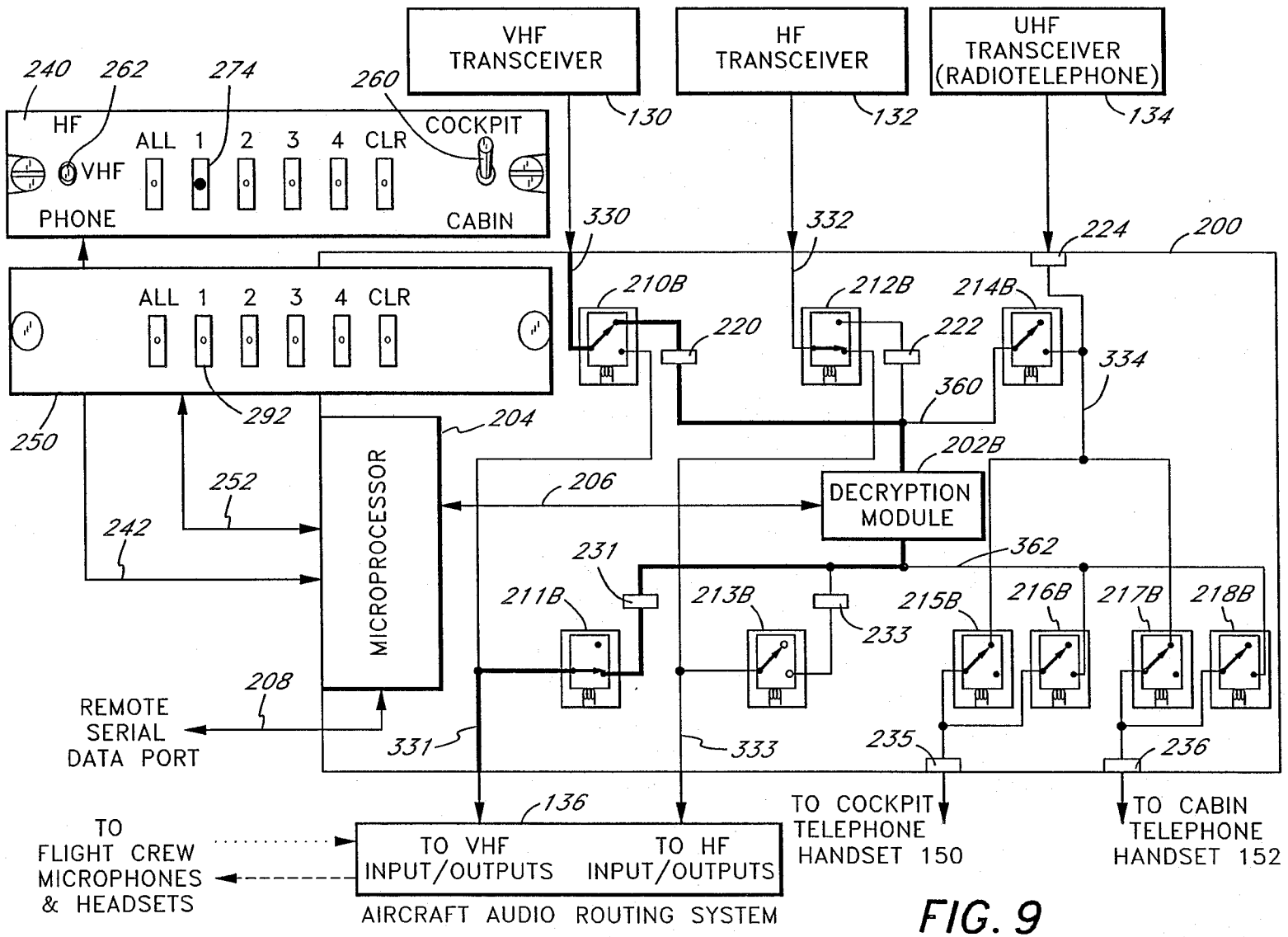
FIG. 9 shows a block diagram of the receive audio path through the encryption/decryption unit for the VHF radio when in the ENCRYPTED mode.

Detailed Description of the VHF Encrypted Mode Audio Paths of FIGS. 8 and 9

FIG. 8 illustrates the VHF transmit path for the encrypted mode of operation when the radio selector switch 262 is in the VHF position, the control selector switch 260 is in the COCKPIT position, and one of the encryption modes is selected (e.g., the encryption control key "1" as indicated by the lighted LED in the encryption control switch 274). (Note: in the drawings a large dark dot in one of the switches on one of the panels indicates that the corresponding indicator is illuminated.) In response to the illustrated selections, the microprocessor 204 has commanded the encryption module via the RS-232C data and control link 206 to use encryption key 1 and has energized the relay 210A and the relay 211A, thus opening the connection through the normally closed contact of the relay 210A and completing a connection through the normally open contacts of the relay 210A and the relay 211A. The HF and UHF transmit path relays are shown in FIG. 8 as remaining in their respective unenergized conditions with their respective contacts opened or closed as in FIG. 6. The VHF microphone audio from the aircraft audio routing system 136 enters the encryption/decryption unit 200 via the signal line 320, as before. However, in this mode the audio signal is routed through the VHF transmit path input signal conditioning circuit 221, through the closed contacts of the relay 211A and to an encryption module input bus 350 that is connected to the input of the encryption module 202A (i.e., the encryption portion 202A of the encryption/decryption module 202, as discussed above). Within the encryption module 202A, the audio signal is encrypted using key in accordance with the proprietary operation of the commercially available encryption module (e.g., the VEM 1000). The encrypted audio is provided as an output from the encryption module 202A on an encryption module output bus 352 and is connected via the VHF transmit path output signal conditioning circuit 230 to the now closed normally open contacts of the relay 210A. The encrypted audio passes through the relay 210A to the signal line 321, to the VHF transmit path output of the encryption/decryption unit 200, and thus to the audio input of the VHF transceiver 130. In this mode, clear audio paths are maintained for the audio inputs to the HF transceiver 132 and the UHF transceiver 134 via the paths described above in connection with FIG. 6 for the unenergized relays. (The paths for the unencrypted audio are not shown in bold in FIGS. 8–15.) Further, it can be seen that there are no connections between the unencrypted portion of the VHF audio path on the encryption module input bus 350 and the audio paths for the HF and UHF transceivers 132 and 134.

FIG. 9 illustrates the VHF receive path for the encrypted mode for the same control switch positions as discussed above in connection with FIG. 8. The microprocessor 204 has energized the relays 210B and 211B to open the normally closed contact of the relay 210B and to close the normally open contacts of both relays. The HF and VHF receive path relays remain in their respective unenergized states with their respective contacts opened or closed as in FIG. 7. The encrypted received audio from the VHF transceiver 130 enters the encryption/decryption unit 200 via the signal line 330 and is routed to the common contact of the relay 210B, as before. The encrypted audio signal passes through the now closed normally open contact of the relay 210B and through the VHF receive path input signal conditioning circuit 220 to a decryption module input bus 360. The decryption module input bus 360 is connected to the input of the decryption module 202B. Within the decryption module 202B, the encrypted audio is decrypted using the decryption key 1. The unencrypted output from the decryption module 202B is provided to a decryption output bus 362 and through the VHF receive path output signal conditioning circuit 231 to the relay 211B. The unencrypted audio signal passes through the now closed contacts of the relay 211B to the signal line 331 and thus to the VHF receive path output of the encryption/decryption unit 200. The unencrypted output signal is thus provided to the aircraft audio routing system 136 whereby it is routed to the headset 142. As illustrated, clear paths are maintained for the audio outputs from the HF transceiver 132 and the UHF transceiver 134 by the unenergized relays in those paths. As further illustrated, there is no connection from the decryption output bus 362 to the HF or UHF transceivers or the corresponding headset or handset whereby the unencrypted audio output can be overheard.

Figure 10:
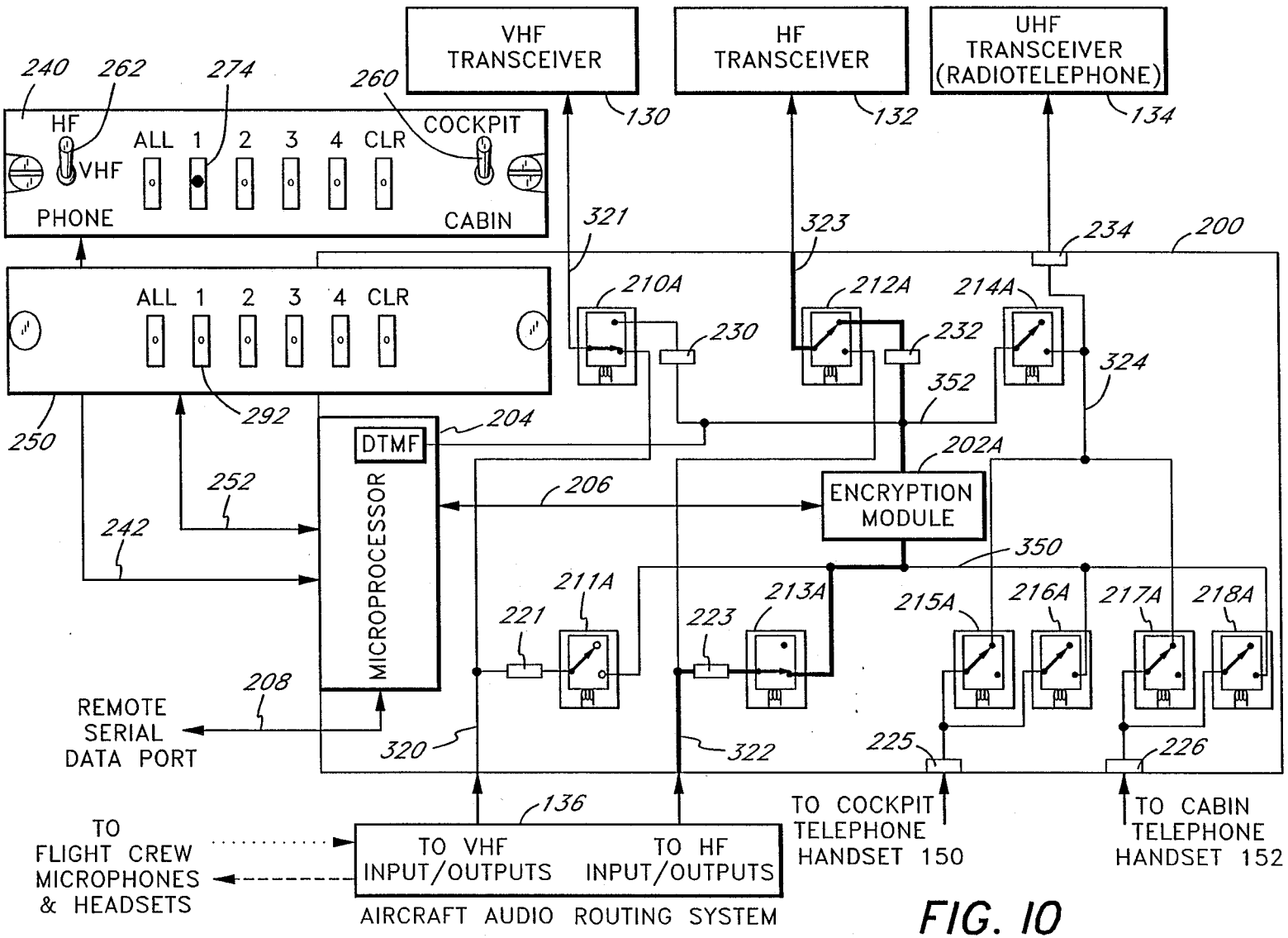
FIG. 10 shows a block diagram of the transmit audio path through the encryption/decryption unit for the HF radio when in the ENCRYPTED mode.
Figure 11:
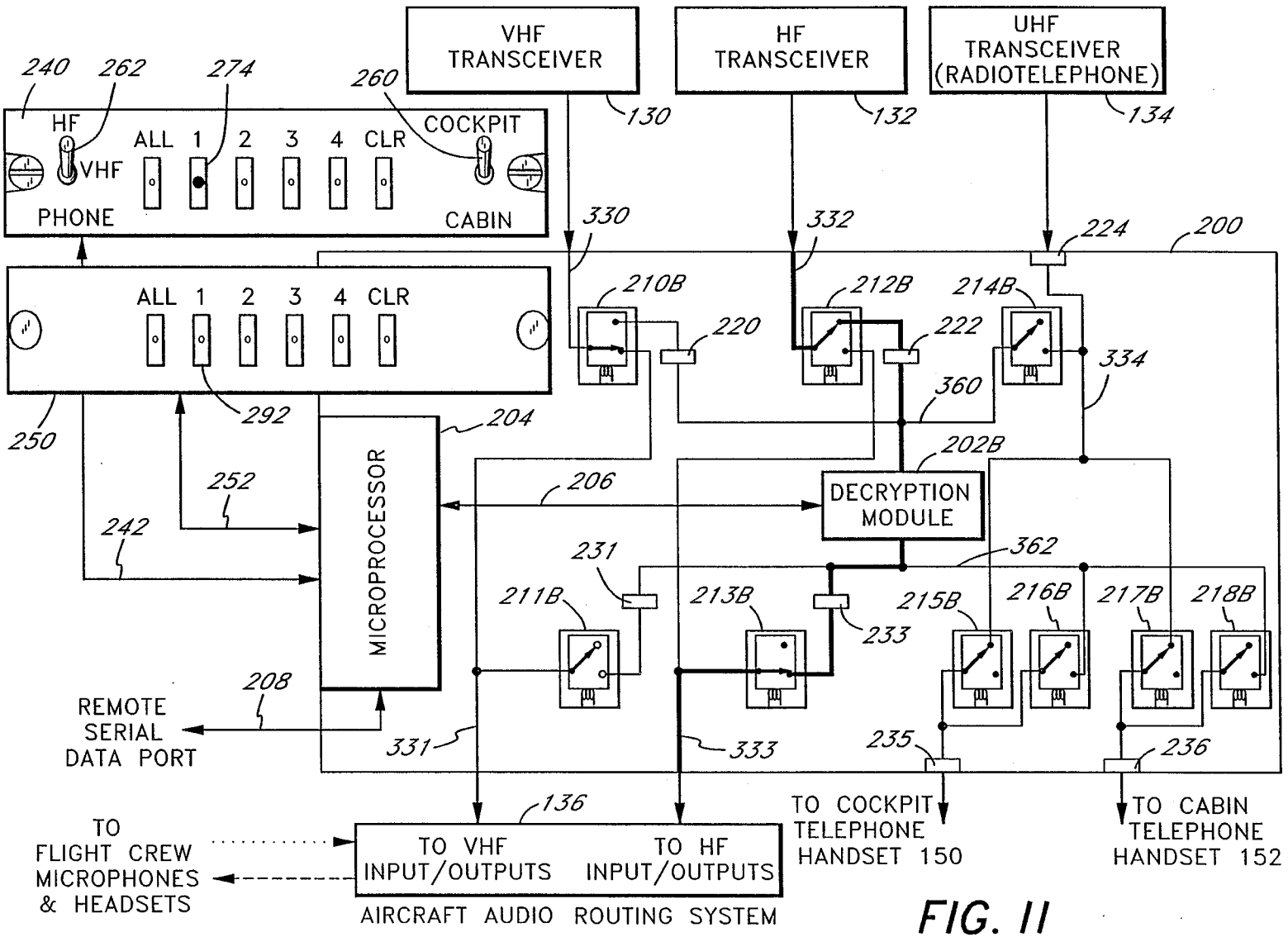
FIG. 11 shows a block diagram of the receive audio path through the encryption/decryption unit for the HF radio when in the ENCRYPTED mode.

Detailed Description of the HF Encrypted Mode Audio Paths of FIGS. 10 and 11

FIG. 10 illustrates the HF transmit path for the encrypted mode of operation when the radio selector switch 262 is in the HF position, the control selector switch 260 is in the COCKPIT position, and one of the encryption modes is selected (e.g., the encryption control key "1" as indicated by the lighted LED in the encryption control switch 274). In response to the illustrated selections, the microprocessor 204 has commanded the encryption module via the RS-232C data and control link 206 to use encryption key 1 and has energized the relay 212A and the relay 213A, thus opening the connection through the normally closed contact of the relay 212A and completing a connection through the normally open contacts of the relay 212A and the relay 213A. The VHF and UHF transmit path relays are shown in FIG. 10 as remaining in their respective unenergized conditions with their respective contacts opened or closed as in FIG. 6. The HF microphone audio from the aircraft audio routing system 136 enters the encryption/decryption unit 200 via the signal line 322, as before. However, in this mode the audio signal is routed through the HF transmit path input signal conditioning circuit 223, through the closed contacts of the relay 213A to the encryption module input bus 350 and thus to the input of the encryption module 202A. Within the encryption module 202A, the audio signal is encrypted using key 1, as discussed above. The encrypted audio is provided as an output from the encryption module 202A on the encryption module output bus 352 and is connected via the HF transmit path output signal conditioning circuit 232 to the now closed normally open contacts of the relay 212A. The encrypted audio passes rough the relay 212A to the signal line 323, to the HF transmit path output of the encryption/ decryption unit 200, and thus to the audio input of the HF transceiver 132. In this mode, clear audio paths are maintained for the audio inputs to the VHF transceiver 130 and the UHF transceiver 134 via the paths described above in connection with FIG. 6 for the unenergized relays. Further, it can be seen that there are no connections between the unencrypted portion of the HF audio path on the encryption module input bus 350 and the audio paths for the VHF and UHF transceivers 130 and 132.

FIG. 11 illustrates the HF receive path for the encrypted mode for the same control switch positions as discussed above in connection with FIG. 10. The microprocessor 204 has energized the relay 212B and 213B to open the normally closed contact of the relay 212B and to close the normally open contacts of both relays. The other receive path relays remain in their respective unenergized states with their respective contacts opened or closed as in FIG. 7. The encrypted received audio from the HF transceiver 132 enters the encryption/decryption unit 200 via the signal line 332 and is routed to the common contact of the relay 212B, as before. The encrypted audio signal passes through the now closed normally open contact of the relay 212B, through the HF receive path input signal conditioning circuit 222 to the decryption module input bus 360, and thus to the input to the decryption module 202B. Within the decryption module 202B, the encrypted audio is decrypted using the decryption key 1. The unencrypted output from the decryption module 202B is provided to the decryption output bus 362 and through the HF receive path output signal conditioning circuit 233 to the relay 213B. The unencrypted audio signal passes through the now closed contacts of the relay 213B to the signal line 333 and thus to the HF receive path output of the encryption/decryption unit 200. The unencrypted output signal is thus provided to the aircraft audio routing system 136 whereby it is routed to the headset 142. As illustrated, clear paths are maintained for the audio outputs from the VHF transceiver 13 and the UHF transceiver 134 by the unenergized relays in those paths. As further illustrated, there is no connection from the decryption output bus 362 to the VHF and UHF transceivers 130 and 134 or to the corresponding headset or handset whereby the unencrypted audio output can be overheard.

Figure 12:
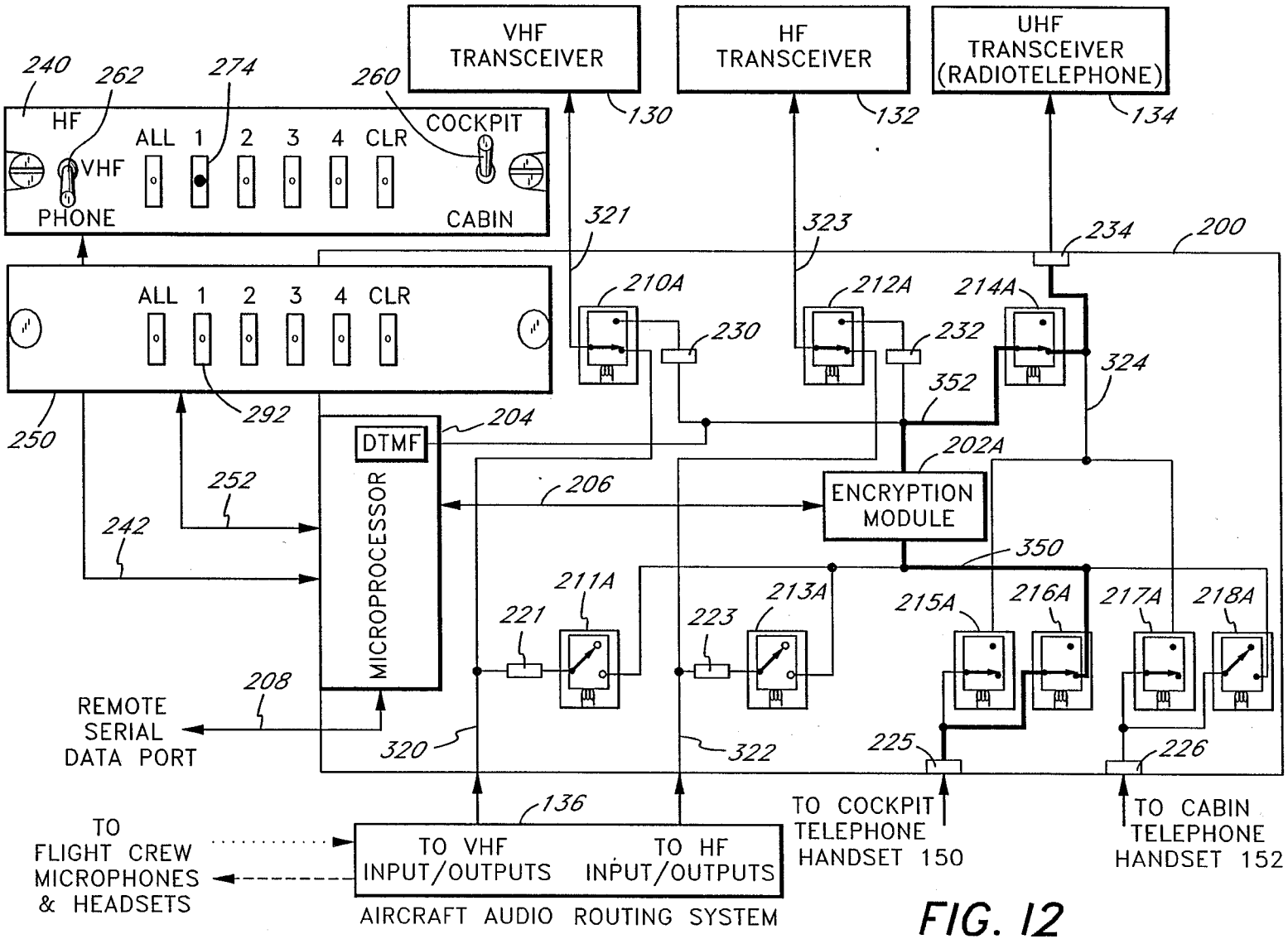
FIG. 12 shows a block diagram of the transmit audio path through the encryption/decryption unit from the Cockpit to the UHF radio when in the ENCRYPTED mode.
Figure 13:
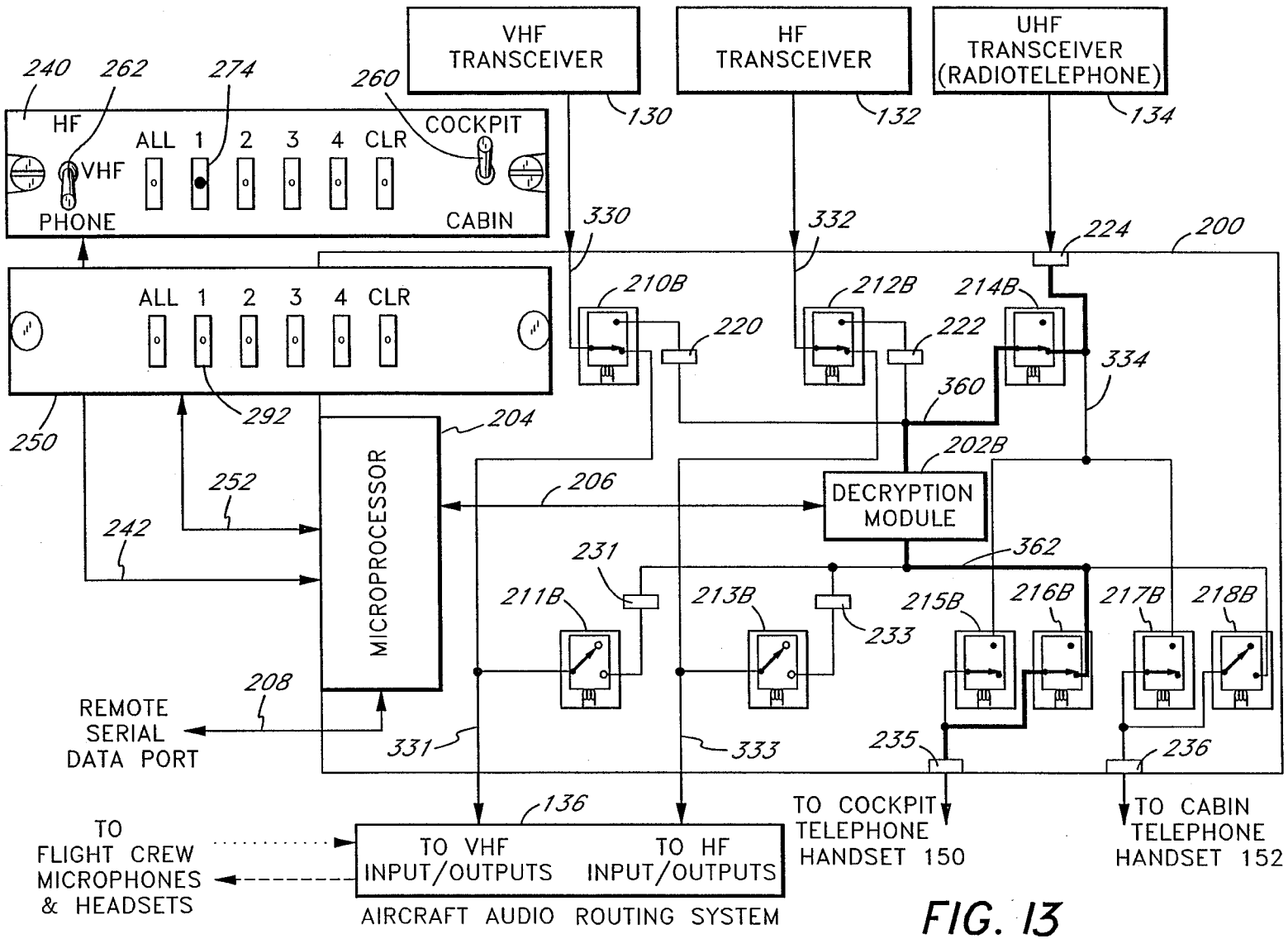
FIG. 13 shows a block diagram of the receive audio path through the encryption/decryption unit from the UHF radiotelephone to the Cockpit when in the ENCRYPTED mode.

Detailed Description of the UHF Cockpit Encrypted Mode Audio Paths of FIGS. 12 and 13

FIG. 12 illustrates the UHF cockpit transmit path for the encrypted mode of operation when the radio selector switch 262 is in the PHONE position, the control selector switch 260 is in the COCKPIT position, and the encryption control switch 274 has been activated to select the encryption key "1", as indicated by the illuminated LED in the switch 274. The microprocessor 204 has commanded the encryption/decryption module 202 to use the encryption key 1 and has energized the relays 214A, 215A, 216A and 217A to close their respective normally open contacts. The other transmit path relays remain in their respective unenergized conditions as in FIG. 6. It should be particularly noted that the relay 218A in the UHF transmit path from the cabin telephone handset 152 remains unenergized. The clear audio from the microphone of the cockpit telephone handset 150 enters the encryption/decryption unit 200 via the input signal conditioning circuit 225 and passes through the closed contacts of the relay 216A to the encryption input bus 350. It should be noted that the clear audio is isolated from the signal line 324 because the normally closed contacts of the relay 215A are now open. The clear audio signal is encrypted within the encryption module 202A using the encryption key 1 and the encrypted audio signal is provided as an output on the encryption output bus 352. The encrypted audio signal passes through the closed contacts of the relay 214A to the output signal conditioning circuit 234 whereby it is provided as the audio input to the UHF transceiver 134. The audio path from the microphone of the cabin telephone handset 152 to the signal line 324 has been disconnected by the opening of the normally closed contacts of the relay 217A, and the cabin telephone handset !52 remains isolated from the encryption input bus 350 since the relay 218A has not been energized. Thus, there is no possibility of a person using the cabin telephone handset 152 at the same time as the cockpit telephone handset 150 in this operational mode. It can be seen that clear audio paths are maintained for the audio inputs to the VHF transceiver 130 and the HF transceiver 132 by the unenergized relays in those paths, as discussed above in connection with FIG. 6. The transmit audio paths for the VHF and HF transceivers 130 and 132 are isolated from the audio paths for the UHF transceiver so that the unencrypted audio cannot be overheard or inadvertently transmitted as unencrypted audio.

FIG. 13 illustrates the UHF cockpit receive path for the encrypted mode of operation when the cockpit control unit has the switch positions described above in connection with FIG. 12. The microprocessor 204 has energized the relays 214B, 215B, 216B and 217B to close their respective normally open contacts. The other receive path relays, including the relay 218B, remain in their respective unenergized conditions as in FIG. 7. The encrypted audio signal received from the UHF transceiver 134 enters the encryption/decryption unit 200 through the input signal conditioning circuit 224 and passes through the closed contacts of the relay 214B to the decryption input bus 360. The encrypted audio signal is decrypted within the decryption module 202B using the key 1 and is provided as a clear audio output signal on the decryption output bus 362. The clear audio output signal passes through the closed contacts of the relay 216B to the output signal conditioning circuit 235 whereby it is provided as an output signal to the earphone of the cockpit telephone handset 150. The encrypted audio output from the input signal conditioning circuit 22 is precluded from reaching the earphone of the cabin telephone handset 152 by the open contacts of the relay 217B and is precluded from reaching the cockpit telephone handset 150 by the open contacts of the relay 215B. More importantly, the clear audio signal from the decryption output bus 362 is precluded from reaching the cabin telephone handset 152 because the normally open contacts of the relay 218B remain open. As illustrated, clear audio receive paths are maintained for the VHF transceiver 130 and the HF transceiver 132 by the unenergized relays in those paths. The receive audio paths for the VHF and HF transceivers 130 and 132 are isolated from the audio paths for the UHF transceiver so that the unencrypted audio cannot be overheard.

Figure 14:
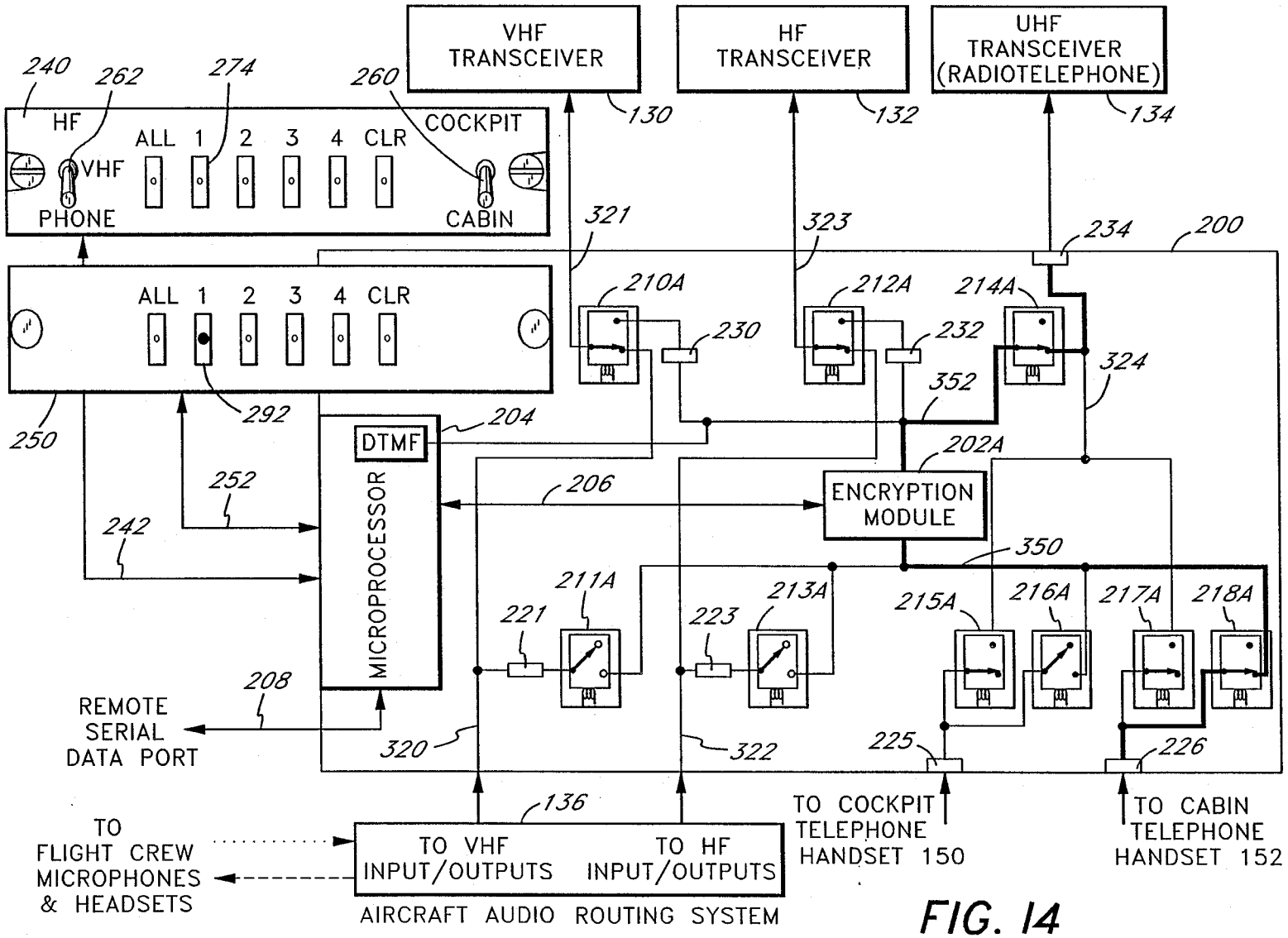
FIG. 14 shows a block diagram of the transmit audio path through the encryption/decryption unit from the Cabin to the UHF radio when in the ENCRYPTED mode.
Figure 15:
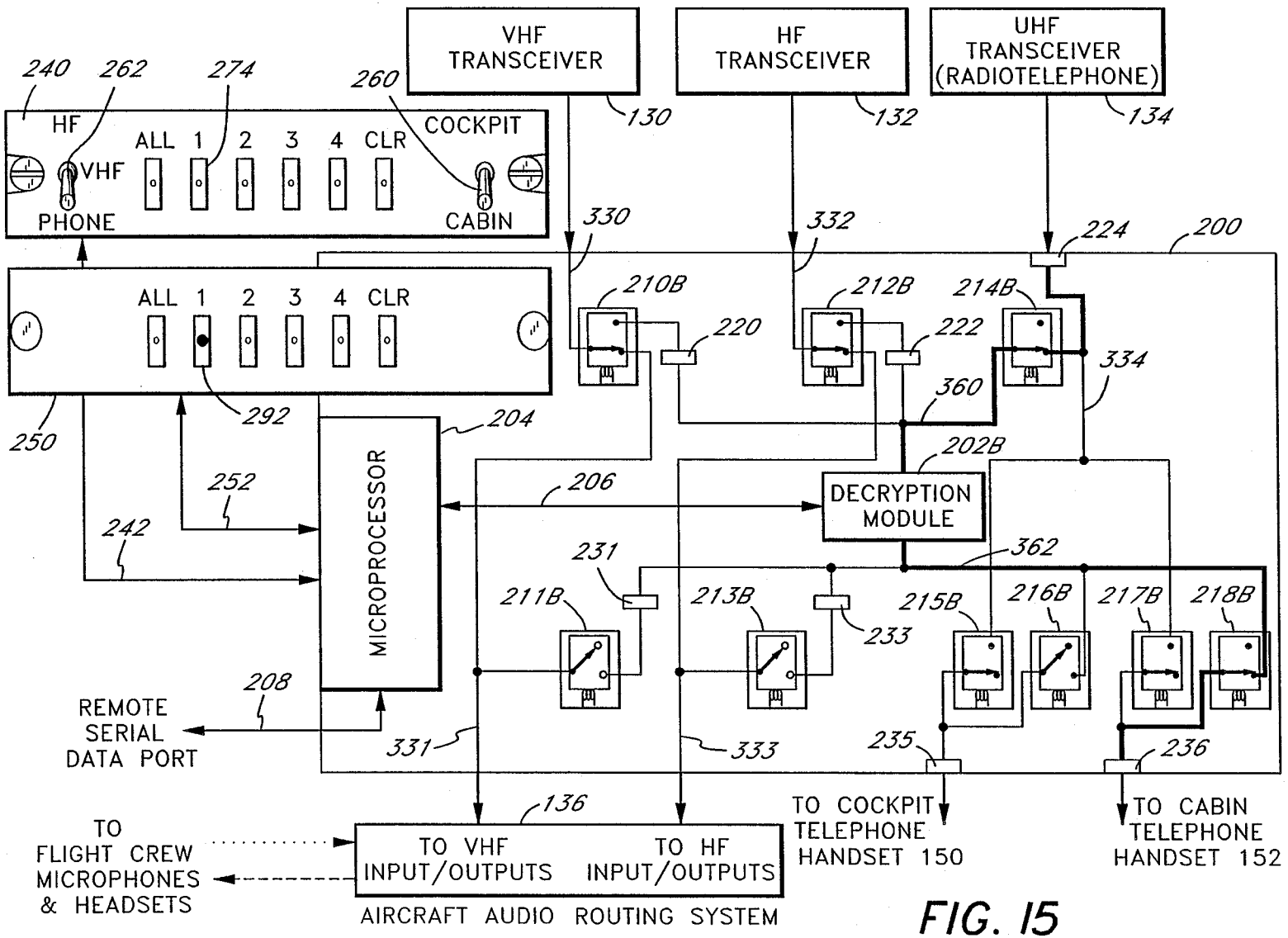
FIG. 15 shows a block diagram of the receive audio path through the encryption/decryption unit from the UHF radiotelephone to the Cabin when in the ENCRYPTED mode.

Detailed Description of the UHF Cabin Encrypted Mode Audio Paths of FIGS. 14 and 15

FIG. 14 illustrates the UHF cabin transmit path for the encrypted mode of operation when the radio selector switch 262 is in the PHONE position and the control selector switch 260 is in the CABIN position. Thus, control over the operation of the UHF radiotelephone has been enabled to the cabin control unit 250. On the cabin control unit 250, the encryption control switch 292 has been activated to select the encryption mode and to select the encryption key "1", as indicated by the illumination of the indicator associated with the switch 292. The microprocessor 204 has commanded the encryption/decryption module 202 via the RS-232C data and control link 206 to use encryption key 1. Furthermore, the microprocessor 204 has energized the relays 214A, 215A, 217A, and 218A to close their respective normally open contacts. The other transmit path relays, including the relay 216A, remain unenergized with their normally open and normally closed contacts in the condition illustrated in FIG. 6. The clear audio signal from the microphone of the cabin telephone handset 152 enters the encryption/decryption unit 200 via the input signal conditioning circuit 226 and passes through the closed contacts of the relay 218A to the encryption input bus 350. The clear audio signal is encrypted within the encryption module 202A using the key 1 and is provided as an encrypted output signal on the encryption output bus 352. The encrypted output signal passes through the closed contacts of the relay 214A to the output signal conditioning circuit 234 whereby it is provided as the encrypted audio input signal to the UHF transceiver 134. The transmit audio path from the cockpit telephone handset 150 to the signal line 324 has been disconnected by the energization of the relay 215A. Furthermore, the clear audio path from the cabin telephone handset 152 has been disconnected by the energization of the relay 217A so that the clear audio signal cannot reach the input of the UHF transceiver 134. As illustrated, clear audio transmit paths are maintained for the VHF transceiver 130 and the HF transceiver 132 by the unenergized relays in those paths. The transmit audio paths for the VHF and HF transceivers 130 and 132 are isolated from the audio paths for the UHF transceiver so that the unencrypted audio cannot be overheard or inadvertently transmitted as unencrypted audio.

FIG. 15 illustrates the UHF cabin receive path for the encrypted mode of operation when the switch settings of the two control panels are as illustrated in FIG. 14. The microprocessor has energized the relays 214B, 215B, 217B nd 218B to close their respective normally open contacts. The other relays in the receive paths, including the relay 216B, remain unenergized, as illustrated in FIG. 7. An encrypted received audio signal from the UHF transceiver 134 enters the encryption/-decryption unit 200 via the input signal conditioning circuit 224 and passes through the closed contacts of the relay 214B to the decryption input bus 360. The encrypted audio signal is decrypted within the decryption module 202B using key and the unencrypted clear audio signal is provided as an output on the decryption output bus 362. The unencrypted audio signal passes through the closed contacts of the relay 218B to the output signal conditioning circuit 236 whereby it is provided as the clear audio output signal to the earphone of the cabin telephone handset 152. The encrypted audio signal from the input signal conditioning circuit 224 is precluded from reaching the earphone of the cockpit telephone handset 150 by the energization of the relay 215B, and is precluded from reaching the earphone of the cabin telephone headset 152 by the energization of the relay 217B. More importantly, the unencrypted clear audio signal on the decryption output bus 362 is precluded from reaching the earphone of the cockpit telephone handset 15 by the normally open contacts of the unenergized relay 216B. As illustrated, clear receive paths are maintained for the VHF transceiver 130 and the HF transceiver by the unenergized relays in those paths. The receive audio paths for the VHF and HF transceivers 130 and 132 are isolated from the audio paths for the UHF transceiver so that the unencrypted audio cannot be overheard.

Figure 16:
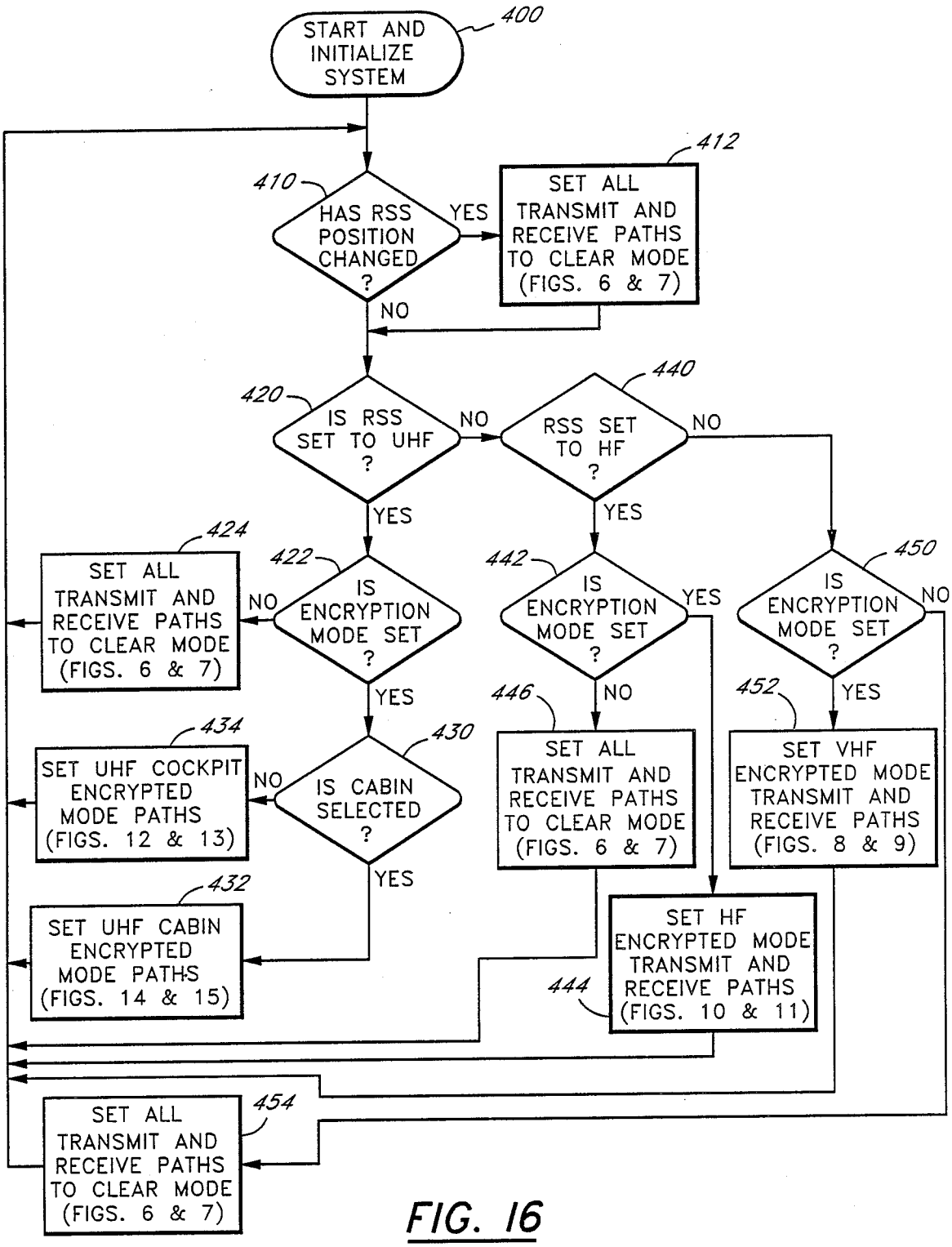
FIG. 16 illustrates a flow chart of an exemplary microprocessor program for controlling the encryption/decryption unit in response to switch positions on the control units.

Detailed Description of the Program Flow Chart of FIG. 16

FIG. 16 is a flow chart of the program within the microprocessor 204 for implementation of the abovedescribed functions wherein the microprocessor 204 monitors the positions of the switches on the cockpit control unit 240 and the cabin control unit 250 and controls the encryption/decryption module 202. The flow chart illustrates the logical decisions made and the actions taken by the microprocessor 204 in response to the sensed switch positions. The program begins at a terminal block 400 wherein the program causes the microprocessor 204 to issue commands to initialize the encryption/decryption unit 200 and to sense the initial positions of all the switches on the currently enabled control unit. At the completion of the initialization process, the encryption/decryption unit 200 is left in the clear mode so that there are no initial inadvertent transmissions in the encrypted mode, for example, by a pilot attempting to communicate with the control tower, or the like. After initialization the program enters a loop that begins with an decision block 410 wherein the microprocessor 204 senses the position of the radio selector switch 262 RSS and compares it to the previously sensed position to determine whether the position has changed. If the position has changed, the program enters an activity block 412 wherein the microprocessor 204 issues output signals to return all the transmit and receive paths to the clear mode so that there is no inadvertent transmission of encrypted data on a newly selected transceiver. Thus, the microprocessor de energizes all the relays to set up the conditions for clear audio as illustrated in FIGS. 6 and 7, and as discussed above.

After completing the clearing activities in the activity block 412, the program enters a decision block 420. The program also will enter the decision block 420 directly from the decision block 410 if the position of the radio selector switch 262 has not changed when sensed in the decision block 410.

Within the decision block 420, the program tests the current position of the radio selector switch 262 to determine whether the radio selector switch 262 is in the UHF position. If the UHF transceiver is selected, the program branches to a decision block 422 wherein the program tests to determine whether one of the encryption modes has been requested by the momentary activation of one of the encryption control switches (i.e., "ALL", "1", "2", "3", or "4") on the currently enabled control unit which sets a status bit within the microprocessor 204. If an encryption mode has not been selected or has been cleared by the activation of the clear ("CLR") encryption control switch on the currently active control unit, the program enters an activity block 424 wherein the microprocessor 204 is caused to issue output signals to clear the transmit and receive paths for all the transceivers in accordance with FIGS. 6 and 7, described above. Thereafter, the program returns to the decision block 410 wherein it again begins the loop to test changes in the radio selection switch 262 and to test the current positions of the switches and the current encryption mode.

Returning to the decision block 422, if the program in the microprocessor 204 determines that an encryption mode is set, the program enters a decision block 430 wherein the position of the controller selector switch 260 is sensed to determine whether it is in the CABIN position to determine whether the encrypted transmission and receive paths should be set for the cockpit telephone handset 150 or the cabin telephone handset 152. If the controller selector switch 260 is in the CABIN position, the program enters an activity block 432 wherein the microprocessor 204 is caused to issue output signals to energize the relays to enable the UHF cabin encrypted transmit and receive paths in accordance with FIGS. 14 and 15. The microprocessor 204 further commands the encryption/decryption module 202 to encrypt and decrypt the audio signals in accordance with the encryption key associated with the last pressed encryption control switch (i.e., "ALL", "1", "2", "3", or "4").

Returning to the decision block 430, if the controller selector switch 260 is not in the CABIN position, the program enters an activity block 434 wherein the microprocessor 204 is caused to issue output signals to energize the relays in accordance with FIGS. 12 and 13 to enable the UHF cockpit encrypted transmit and receive paths, and to issue appropriate commands to control the encryption/decryption module 202. After completing the operations in either the activity block 432 or the activity block 434, the program returns to the decision block 410 to begin the loop again.

Returning to the decision block 420, if the radio selector switch 262 was not in the UHF position, the program enters a decision block 440 wherein the radio selector switch 262 is tested to determine whether it is in the HF position. If the radio selector switch 262 is in the HF position, the program enters a decision block 442 wherein the program tests to determine whether an encryption mode has been set by one of the encryption switches, as discussed above. If an encryption mode has been set, the program enters an activity block 444 wherein the microprocessor 204 is caused to issue output signals to energize the relays for the HF encrypted transmit and receive paths in accordance with FIGS. 9 and 10, and to issue commands to the encryption/decryption module 202 to encrypt and decrypt the audio signals in accordance with the encryption key associated with the last pressed encryption control switch (i.e., "ALL", "1", "2", "3", or "4"). Thereafter, the program returns to the decision block 410 to restart the loop.

Returning to the decision block 442, if an encryption mode is not set, the program enters an activity block 446 wherein the microprocessor 204 issues output signals to deenergize all the relays to set up the conditions clear audio paths for all the transceivers in accordance with FIGS. 6 and 7. Thereafter, the program returns to the decision block 410 to restart the loop.

Returning to the decision block 440, if the radio selector switch 262 is not in the HF position and thus must be in the VHF position, the program enters a decision block 450 wherein the program tests to determine whether an encryption mode has been set by one of the encryption switches, as discussed above. If an encryption mode has been set, the program enters an activity block 452 wherein the microprocessor 204 is caused to issue output signals to energize the relays for the VHF encrypted transmit and receive encryption paths in accordance with FIGS. 8 and 9, and to issue commands the encryption/decryption module 202 to encrypt and decrypt the audio signals in accordance with the encryption key associated with the last pressed encryption control switch (i.e., "ALL", "1", "2", "3", or "4"). Thereafter, the program returns to the decision block 410 to restart the loop.

Returning to the decision block 450, if an encryption mode is not set, the program enters an activity block 454 wherein the microprocessor 204 is caused to issue output signals to de-energize all the relays to set up the clear audio paths for all the transceivers in accordance with FIGS. 6 and 7. Thereafter, the program returns to the decision block 410 to restart the loop.

A particularly preferred embodiment of the present invention has been described above. Although the invention has been described with reference to this specific embodiment, the description is intended to be illustrative of the invention is not intended to be limiting. Various modifications and applications may occur to those skilled in the art without departing from the true spirit and scope of the invention as defined in the appended claims.

What is claimed is:

1. A communication system for an aircraft that selectably provides an encrypted communication path between a user and a selected radio transceiver, said system comprising:

at least one first voice communication device in the cockpit of the aircraft that responds to the voice of a person in the cockpit to transmit a first communication device audio output signal, and that responds to a first communication device audio input signal to generate a first audible output signal;

a second voice communication device in the passenger cabin of the aircraft that responds to the voice of a person in the passenger cabin to transmit a second communication device audio output signal, and that responds to a second communication device audio input signal to generate a second audible output signal;

a first radio transceiver that receives a first transceiver audio input signal and generates a modulated radio frequency output signal responsive thereto, and that receives a modulated radio frequency input signal and generates a first transceiver audio output signal responsive thereto;

a second radio transceiver that receives a second transceiver audio input signal and generates a modulated radio frequency output signal responsive thereto, and that receives a modulated radio frequency input signal and generates a second transceiver audio output signal responsive thereto;

an encryption/decryption system that includes an encryption/decryption module, a first control unit located in said cockpit and a second control unit located in said passenger cabin, each control unit having a plurality of switches, said encryption/decryption module responsive to an intelligible audio input signal to generate an encrypted audio output signal in accordance with a selected encryption key, said encryption/decryption module further responsive to an encrypted audio input signal to generate an intelligible output signal, said encryption/ decryption system interposed between said first and second voice communication devices and said first and second transceivers and responsive to said switches on said control units so that:

said encryption/decryption system receives said first and second communication device audio output signals and selectably provides one of said first and second communication device audio output signals as said intelligible audio input signal to said encryption/decryption module to be encrypted therein;

said encryption/decryption system selectably provides said encrypted audio output signal as one of said first and second transceiver audio input signals while providing the other of said first and second communication device audio output signals as the other of said first and second transceiver electrical input signals;

said encryption/decryption system receives said first and second transceiver audio output signals and selectably provides one of said first and second transceiver audio output signals as said encrypted input signal to said encryption/ decryption module to be unencrypted therein; and said encryption/decryption system selectably provides said intelligible audio output signal from said encryption/decryption module as one of said first and second communication device audio input signals while providing the other of said first and second transceiver electrical output signals as the other of said first and second communication device audio input signals 2. The communication system as defined in claim 1, wherein one of said control units is disabled when the other of said control units is enabled so that only said enabled control unit controls said encryption/decryption system.

3. The communication system as defined in claim 2, wherein said control unit in said passenger cabin is subordinate to said control unit in said cockpit so that the selection of the enabled control unit is determined by said control unit in said cockpit.

4. The communication system as defined in claim 1, wherein said first and second communication device audio inputs are electrically isolated so that said intelligible audio input and output signals provided to one of said first and second communication devices are not provided to the other of said first and second communication devices.

5. The communication system as defined in claim 1, wherein one of said second communication device is a radio telephone handset in the cabin of said aircraft, said aircraft further including a second radio telephone handset in the cockpit of the aircraft, said encryption/-decryption system including circuitry to selectably electrically isolate said radio telephone handset in the cabin from said radio telephone handset in the cockpit so that only one of said radio telephone handsets can transmit audio signals to and receive audio signals from said encryption/ decryption module at any one time.

6. An aircraft communications system that selectably provides an encrypted communication path between a selected user location and a selected radio transceiver, said system comprising:

a first user location comprising a first voice communication device that receives an audio input from a user at that first location and transmits a first voice communication device electrical output signal responsive thereto and that receives a first voice communication device electrical input signal and generates an audio output perceivable to the user at the first location;

a second user location, remote from said first user location, comprising a second voice communication device that receives an audio input from a user at that second location and transmits a second voice communication device electrical output signal responsive thereto and that receives a second voice communication device electrical signal and generates an audio output perceivable to the user at the second location;

a first radio transceiver that receives a first transceiver electrical input signal and generates a modulated radio frequency output signal responsive to the first transceiver electrical input signal, and that receives a modulated radio frequency input signal and generates a first transceiver electrical output signal responsive to the radio frequency input signal;

a second radio transceiver that receives a second transceiver electrical input signal and generates a modulated radio frequency output signal responsive to the second transceiver electrical input signal, and that receives a modulated radio frequency input signal and generates a second transceiver electrical output signal responsive to the radio frequency input signal;

an encryption/decryption system that includes an encryption/decryption module, said encryption/decryption module responsive to an electrical input signal representing intelligible audio input to generate an encrypted electrical output signal in accordance with a selected encryption key, said encryption/decryption module further responsive to an electrical input signal representing encrypted audio input to generate an electrical output signal representing intelligible audio output, said encryption/-decryption system interposed between said first and second voice communication devices and said first and second transceivers so that:

said encryption/decryption system receives said first and second voice communication device electrical output signals and selectably provides one of said first and second voice communication device electrical output signals as an unencrypted input to said encryption/decryption module to be encrypted therein;

said encryption/decryption system provides said first and second transceiver electrical input signals to said first and second radio transceivers, respectively, and selectably provides said encrypted electrical output signal from said encryption/decryption module as one of said first and second transceiver electrical input signals while providing the other of said first and second voice communication device electrical output signals as the other of said first and second transceiver electrical input signals;

said encryption/decryption system receives said first and second transceiver electrical output signals and selectably provides one of said first and second transceiver electrical output signals as the encrypted input signal to said encryption/-decryption module to be unencrypted therein;

said encryption/decryption system provides said first and second voice communication device input signals to said first and second voice communication devices, respectively, and selectably provides said unencrypted electrical output signal from said encryption/decryption module as one of said first and second voice communication device electrical input signals while providing the other of said first and second transceiver electrical output signals as the other of said first and second voice communication device electrical input signals.

7. The communication system as defined in claim 6, wherein said first user location is in the cockpit of an aircraft and wherein said second user location is in the cabin of the aircraft.

8. The communication system as defined in claim 6, further including a first control panel at said first user location and a second control panel at said second user location, said control panels including switches electrically connected to said encryption/decryption system and operable to select an input to and an output from said encryption/decryption module.

9. The communication system as defined in claim 8, wherein one of said first and second control panels further includes a switch that is operable to select which of said first and second control panels is enabled to control said encryption/decryption system.

10. The communication system as defined in claim 9, wherein said one of said first and second control panels further includes a switch that selects which of said first and second transceivers has its electrical output connected to receive the encrypted output from said encryption/ decryption module and has its electrical input connected to provide the encrypted input to said encryption/decryption module.

11. The communication system as defined in claim 6, wherein at least one of said first and second voice communication devices and a corresponding one of said first and second transceivers comprise a UHF radiotelephone.

12. The communication system as defined in claim 6, wherein at least one of said first and second transceivers is a VHF transceiver.

13. A radio communication system for an aircraft that includes at least first and second radio transceivers and at least first and second locations within said aircraft having audio communication equipment for providing input signals to and receiving output signals from said transceivers, said radio communication system comprising:

an encryption/decryption module that receives an unencrypted input and provides an encrypted output responsive thereto and that receives an encrypted input and provides an unencrypted output responsive thereto; and a reconfigurable interconnection circuit that selectably interconnects inputs to and outputs from said encryption/decryption module, said interconnection circuit providing a first interconnection path through said encryption/decryption unit that connects the audio communication equipment from a selected one of said first and second locations to the unencrypted input and the unencrypted output of said encryption/decryption module and that connects the encrypted input and the encrypted output of said encryption/decryption module to a selected one of said first and second transceivers, said interconnection circuit providing electrical isolation between said audio communication equipment from said first and second locations so that no interconnection path is provided between said encryption/decryption module and the non-selected audio communication equipment.

* * * * *